US005429116A

United States Patent [19]

Brown

[11] Patent Number: 5,429,116

[45] Date of Patent: Jul. 4, 1995

[54] ADJUSTABLE VENTILATOR

[76] Inventor: Stephen L. Brown, 33 W. Hinman Ave., Columbus, Ohio 43207

[21] Appl. No.: 83,366

[22] Filed: Jun. 28, 1993

[51] Int. Cl.[6] ..... F24C 15/20

[52] U.S. Cl. ..... 126/299 D; 126/301; 126/314; 285/205; 285/424; 55/DIG. 36

[58] Field of Search ..... 126/299 R, 299 D, 301, 126/314; 285/205, 424; 55/DIG. 36

[56] References Cited

U.S. PATENT DOCUMENTS

| | | | |
|---|---|---|---|
| 2,987,330 | 6/1961 | Curran | 285/424 |
| 3,323,439 | 6/1967 | Weaver et al. | 126/299 D |
| 3,566,585 | 3/1971 | Voloshen et al. . | |
| 3,870,494 | 3/1975 | Doane . | |
| 4,281,635 | 8/1981 | Gaylord . | |
| 4,346,692 | 8/1982 | McCauley . | |
| 4,373,509 | 2/1983 | Neitzel et al. . | |
| 4,887,587 | 12/1989 | Deutsch | 126/299 D |
| 5,320,088 | 6/1994 | Nester | 126/299 D |

*Primary Examiner*—Carroll B. Dority
*Attorney, Agent, or Firm*—Woodard, Emhardt, Naughton Moriarty & McNett

[57] ABSTRACT

Removable filters tailored to pollution by different cookers under a hood, have locating punched out notches on locator pins located on a removable drain trough according to a pattern whereby, after the filters are removed for cleaning, they must be re-installed in their original locations. A field-installed outlet collar assembly includes a flanged one-piece inner collar received up through a field-cut opening in the hood top. Two tapered half frames are hammered in laterally, wedging between the top of the hood and the top flange of the collar, sealing the bottom flange of the collar to a gasket sealed to the underside of the hood top. An access door assembly is similarly field-installed. Exhaust duct sections have joint features snapped together and interlocking.

Fire damper assemblies inside the exhaust and make-up air plenums include horizontally slidable panels positionable in a maximized standardized hood to reduce its flow rates to match specific cooking fume ventilating requirements. The panels are spring biased against position locating pins which are fusible to permit closure of the panels in case of fire. Adjustable fire dampers at intake slots of make-up air diffuser assemblies are closable to selectable stop pin locations to match makeup air to the cooking units. The stop pins are fusible to permit the panels to close in case of fire.

33 Claims, 15 Drawing Sheets

ADJUSTABLE VENTILATOR

BACKGROUND OF THE INVENTION

1. Field of the Invention

This invention relates generally to kitchen ventilation systems, and more particularly to an exhaust hood and associated ductwork for handling cooking fumes generated during cooking with different types of cooking appliances situated under the hood.

2. Description of the Prior Art

Various states in the United States have very specific guidelines for the food service ventilation industry. Perhaps the most stringent guidelines have been established by the State of Michigan. Among other aspects of the guidelines are four categories of ventilation rates for different types of cooking appliances as follows:

1. Low heat, low grease;
2. Grease producing;
3. Heat and grease producing;
4. High heat and grease producing.

In various food service establishments, it is the norm that appliances from one, more than one, or even all categories will be found in a line under the same exhaust hood. Therefore, different ventilation rates are needed at different locations along the length of the hood in accordance with the type of appliances in the line-up under the hood.

The State of Michigan as well as National Building Codes including BOCA (Building Officials and Code Administration) ICBO (International Conference of Building Officials) and Fire Prevention Codes NFPA (National Fire Prevention Association), author codes regulating the manufacture of commercial grease hoods, and all codes mentioned require that baffle type grease filters, tested in accordance with Underwriters Laboratories standards, be used. These filters remove from the ventilated air stream, grease vaporized and emitted during the cooking process, and provide a fire barrier between the portion of the hood exposed over the cooking appliance, and the concealed portion of the hood located behind the grease filters. Overlapping baffles, within each filter, create a barrier to prevent the flames generated during a cooking appliance grease fire, from passing directly through unobstructed openings into the ventilation duct which runs through concealed building spaces above ceilings and into other rooms. The overlapping baffles require the air passing through the filter to change directions to maneuver around the baffles. These changes in directions or turning of the air stream creates centrifugal forces at each turn. This centrifugal force causes the heavier grease vapor and grease droplets to be thrown against the opposing baffle. The grease is collected on, or attaches, to the baffle face and drains down the baffle to a drip trough, located beneath the filter. The trough is pitched for drainage of the collected grease to a removable grease catch pan.

State of Michigan ventilation requirements require each filter manufacturer to publish a chart indicating optimum performance. These charts indicate, in accordance with manufacturer's testing, the optimum velocity range for peak filter efficiency. Codes as well as good ventilation practice require the filter be sized to the cubic feet per minute (cfm) being ventilated. In addition, the guidelines and good practice require the filters to run the full length of the ventilator exhaust chamber. When filters do not fit the exact length of the exhaust chamber, the Michigan guideline limits the space utilizing blank panels or filler panels, to complete the shortage in filter length, to 16% of total filter area. Virtually all baffle filters require the exhaust air to make a minimum of two turns around the baffles as it passes through the filter from the intake or inlet face of the filter to the exhaust or outlet face. The State of Michigan also requires filter manufacturers to publish the velocities to be maintained that will produce maximum grease extraction efficiency. This published report must also include the net free area of each filter. The net free area is used to determine which filter size will provide the required velocity at a given ventilation air volume. Industry testing of various filters have demonstrated these velocities, producing maximum grease extraction efficiency, to be between 275 feet per minute (f.p.m.) minimum and 400 f.p.m. maximum.

An additional Michigan requirement is the pressure drop across the filters be equal to or greater than 0.30" w.c. (water column) when using a single duct collar in a hood length exceeding 10'-0". Lower pressure drops can be accommodated by adding additional duct take offs. These additional take offs add installation and maintenance expenses. As the ducts are above the hood and therefore normally concealed above the ceiling there is often insufficient space to accommodate the additional duct. The connecting duct transport velocity is restricted by code to a minimum of 1,500 f.p.m. and a normal maximum of 4,000 f.p.m. As a result of the combination of requirements of the codes, it is very difficult to achieve ventilation in a given hood where the cooking appliances under the hood are in different categories. It is even more difficult to obtain optimum ventilation performance and/or economy. In addition, if the requirements of the food service establishment indicate a need for a different arrangement of different categories of cooking units under the hood, it can be very difficult to achieve the code-specified filter performance, much less optimize the arrangement. Also, if different filters are used, they are not likely to fit into the same grease filter frame, thus requiring different hood designs. Therefore, if appliances are changed or relocated under the hood, and more or less air is required, a new hood will be required. Changes going from low heat and low grease, to heat and grease, can be impossible because the smaller filters for the low heat and low grease application creates such increased pressure drop that the fan cannot provide the required volume of air flow for the larger filters.

As mentioned above, one of the Michigan requirements pertains to a minimum pressure drop requirement when using a single duct collar in a hood length exceeding ten feet. Lower pressure drops can be accommodated by adding additional duct take-offs, but these additional take-offs add installation and maintenance expense. Nevertheless, it is sometimes necessary. In addition to state codes, installations must meet the requirements of local government codes. There is a trend for governmental municipalities to accept only hoods bearing the label of one of the nationally recognized testing laboratories. Listed hoods bearing such labels have specifications for placement of an exhaust duct opening collar within a limited range of locations relative to the transverse center line of the hood. But problems may arise at the hood installation site, because building codes prohibit any installation such that roof joists, plumbing lines, electrical lines or other devices would penetrate the exhaust duct running from the hood to the roof-mounted fan. However, such building components typically run in the space between ceiling above the hood, and the roof. Therefore it is frequently a problem to coordinate the factory installed location of the exhaust collar with the field location of obstructions. Consequently, it is common to see in the field, a labeled hood which has been installed with the factory located collar cutout welded closed and the duct welded to the hood in a different location that was necessitated by structural members or mechanical services already in the building and which could not be moved. Such field welding of a collar is not in compliance with the testing laboratory listing, and can put the burden of acceptance or rejection on a local government code official who does not want that burden or is not trained to make the necessary judgment.

In addition to the above-mentioned hood-to-duct connection problem resulting from building mechanicals being in the ceiling space, the routing of the duct to the roof-mounted exhaust fan can also be a challenge. It sometimes involves turns in direction or long duct runs. Codes require that a clean-out or access door be provided at each turn in direction and at intervals no greater than twenty feet apart in long duct runs. Typically the access doors include frames welded to the perimeter of an opening cut into the wall of the duct. Then a door is screwed or otherwise fastened to the frame. The welding is difficult to accomplish, since the space available in which to work is very limited. Yet it is desirable to install the clean-outs after the ducts are in place in the building, to be certain that there is no conflict with other mechanicals that would restrict access to them for clean-out. Since it is necessary to route ductwork in the field, joints are inevitable. Building codes require not only that the duct sections themselves be constructed with liquid-tight continuous external welds at all seams and joints, but also that all joints made in the field during installation must be made using the same liquid-tight continuous external welds. As indicated above, these code requirements make kitchen ventilation system installations difficult and expensive.

Some efforts to address at least the problem of different requirements for different types of cooking units have been made and the results disclosed in some United States patents. For example, the U.S. Pat. No. 4,281,635 issued Aug. 4, 1981 to Gaylord, addresses the problem of different amounts of air pollution by different cooking units, but does so in a water-wash hood. Such hoods typically cost two to three times as much as canopy hoods with dry filters. The Gaylord patent teaches the use of choke attachments such as 60, 61 and 63, cut to a length corresponding to the combined width of the low polluting cooking units with which a portion of the hood length is associated. They are installed by spot welds, screws or "other suitable means". They are used to throttle, choke or otherwise restrict the inlet flow to that portion of the ventilator in which they are used. They can be removed by removing the screws and burning off the spot welds, for example.

Dry filters of the baffle type can be made along the lines shown generally in U.S. Pat. No. 3,870,494 issued Mar. 11, 1975 to Doane. An approach to providing different capacities in different portions of a hood using baffle filters is to use a filter unit which is adjustable in itself. An example is shown in U.S. Pat. No. 3,566,585 issued Mar. 2, 1971 to Voloshen et al. Such filters have an adjustment screw 50 operable to change the spacing between baffle members. But such filters are expensive, and the adjustment feature is either not used or not effectively usable. A McCauley U.S. Pat. No. 4,346,692 issued Aug. 31, 1982 uses adjustable louvers or damper blades in the hood itself or in a make-up air module, but not tailored to accommodate individual requirements of a variety of types of cooking equipment under the hood. Similarly, the Neitzel et al. U.S. Pat. No. 4,373,509 issued Feb. 15, 1983, provides adjustable dampers in the hood to change relative amounts of fresh air and tempered air used as make-up air in a kitchen ventilating system as various combinations of cooking equipment are used.

The present invention is addressed to facilitating original installation of a kitchen ventilation system, and minimizing the necessity of any changes of hood or duct to accommodate changes in cooking equipment types and combinations of types served by the exhaust hood in the system.

SUMMARY OF THE INVENTION

According to a typical embodiment of the present invention, a hood located over a row of cooking units of different types, has removable baffle type grease filters of uniform height but of different widths and thicknesses and with slots of different heights to handle the particular pollution generating capabilities of the particular cooking units over which the filters are situated. A removable grease drain channel having a length to fit just inside the length of the hood and readily removable from the hood, if desired, has locator members in it which are at spaced points along the drain channel. The removable grease filters have a set of partially punched knock-outs along the lower marginal portions of the intake faces. When it is determined what particular filter is needed in a particular location along the length of the hood, one of the knock-outs in the filter corresponding to the locator member location in the drain channel, is punched out so that, after the filters have been removed for cleaning and upon reinstallation, only the correct filters can be placed at any location along the hood. Means are provided at the outlet faces of the filters to accommodate the different thicknesses of different filters and keep the upper margins of the filters snug against the upper margins of the hood inlet opening.

The hood outlet is provided with a field-installed collar assembly which includes a flanged one-piece inner collar received up through a field-cut opening in the top of the exhaust hood. Two half frames are driven in from the top, bringing the one-piece collar into position, sealing a flange thereon to a gasket to the top of the hood. Access door assemblies are also field-installed using a one-piece door frame similar to the one-piece inner collar frame, a two-piece hammer-in outer collar and a one piece door bolted to the secured combination of the outer collar and inner door frame. Exhaust duct sections have rolled edges which are formed to hem-like configuration and are snapped together for end-to-end connection of duct sections, and they have additional folds for interlocking to prevent separation due to expansion or contraction of the duct sections in response to hood and duct temperature changes.

Adjustable fire dampers are located inside the exhaust and make-up air (mua) plenums. Each is movable through a range of motion which provides different amounts of opening of the air flow path to and from the respective plenum. Each is positionable at one of a group of selectable positions in the range and which can be determined by a locating pin at the location. The pins are heat fusable to permit automatic closure by the damper in case of fire.

Adjustably positioned fire dampers are also located at the intake slot of the make-up air diffusers along the length of the make-up air plenum. When the required cfm of make-up air is lower than the design maximum, the damper is closed to one of a plurality of possible preselectable pin locations located on the damper guide. Closing this damper restricts the opening, increasing the pressure drop through the opening and reducing the volume of air being supplied from the make-up air plenum. When the adjustable dampers at the intake slots of the diffusers distribute the correct amount of air into each diffuser so that the air supplied through the diffuser corresponds to the amount of air being exhausted through the baffle filter directly opposite. In addition, the location of the fire damper in the intake slot provides a fire break inside the plenum, preventing the diffuser in the front of the make-up air plenum from discharging out the face of the ventilator. Therefore, flames of a cooking fire contained within the exhaust portion of the ventilator are prevented from migrating back into the make-up air plenum and out the front of the ventilator.

DESCRIPTION OF THE PREFERRED EMBODIMENT

Figure 1:
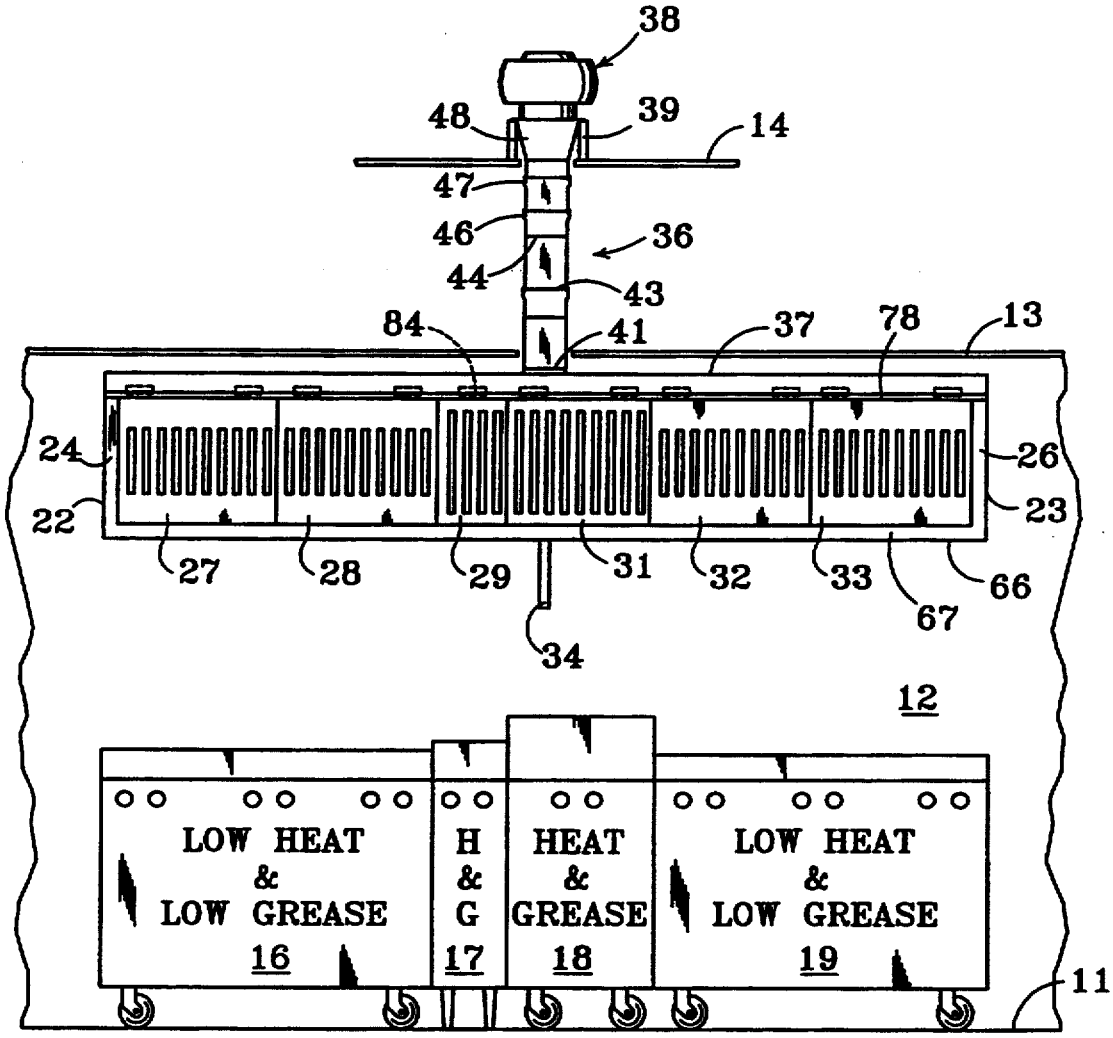
FIG. 1 is a schematic front elevational view of the exhaust side of a kitchen ventilation system according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
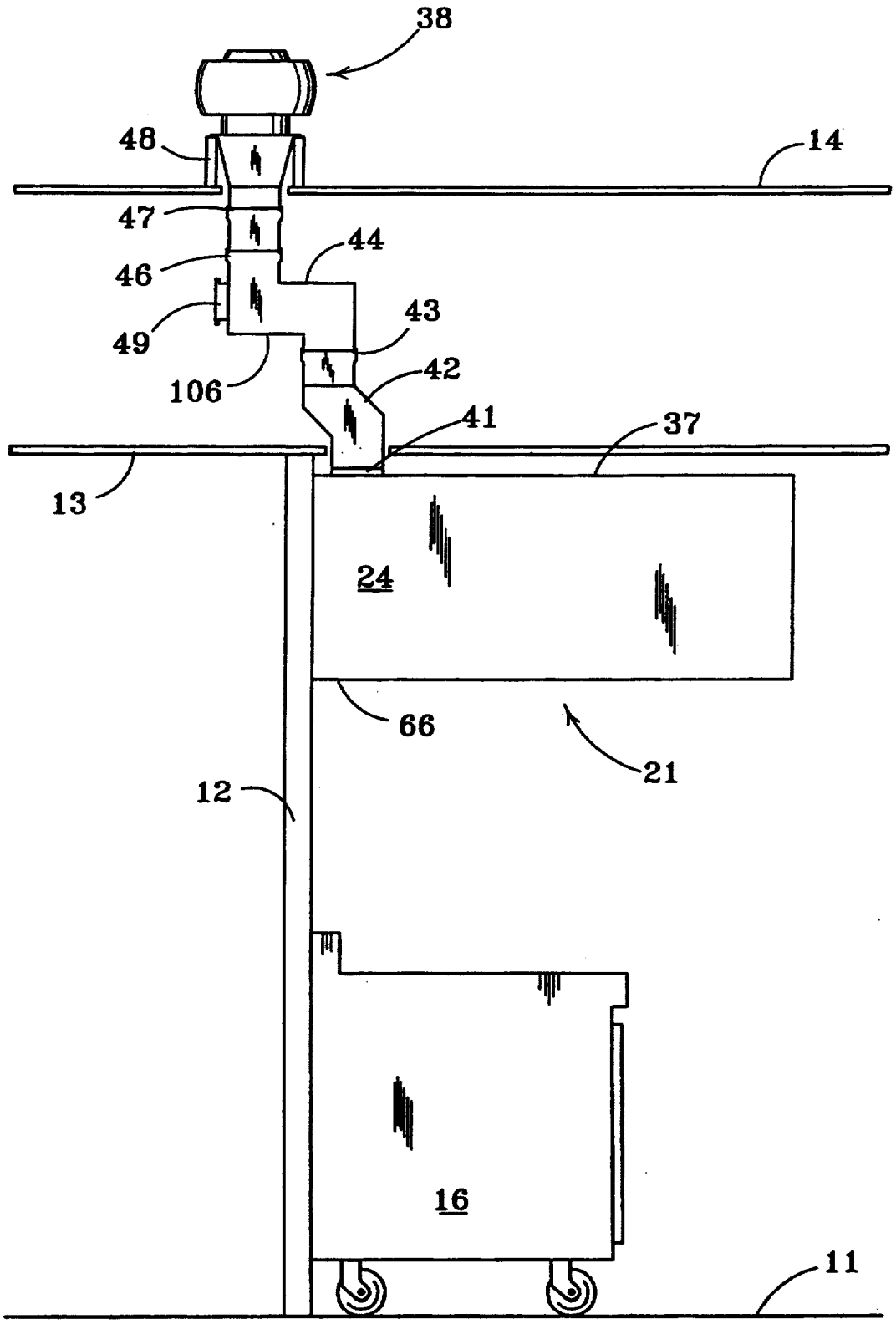
FIG. 2 is a schematic side elevational view thereof.

Referring now to the drawings in detail, and particularly FIGS. 1 and 2, a portion of a building kitchen is shown with a floor 11, wall 12, ceiling 13 and roof 14. Four cooking units 16, 17, 18 and 19 are lined up in a row under a wall-hung hood assembly 21. In this particular example, the cooking units 16 and 19 can be surface ranges and/or ovens with griddles, which are of the low heat, low grease category according to the above-mentioned Michigan standards. Units 17 and 18 are deep fryers which are in the heat and grease producing category.

Hood 21 is twelve feet long between its ends 22 and 23 and has an open front essentially the same length except for the face flanges 24 and 26 at each end. In this illustrated example, the hood has six filters spaced along its length. They are filters 27, 28, 29, 31, 32 and 33. They occupy the entire front opening according to a pattern which will be described. Collected grease can flow down a drain 34 from the bottom of the hood to a suitable receiver (not shown).

An exhaust duct assembly 36 is constructed between the top 37 of the hood and a roof mounted blower assembly 38 mounted on a roof curb 39. The duct assembly includes a field-installed collar assembly 41, double off-set 42, joint 43, double elbow section 44, joints 46 and 47, and curb adaptor 48. An access door assembly is provided in the end of the double elbow at 49.

Figure 5:
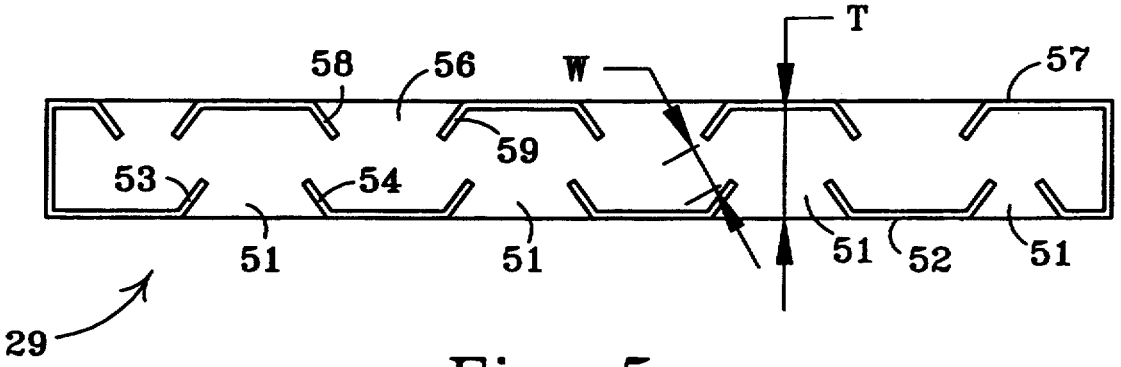
FIG. 5 is a further enlarged transverse section through a baffle-type filter.
Figure 6:
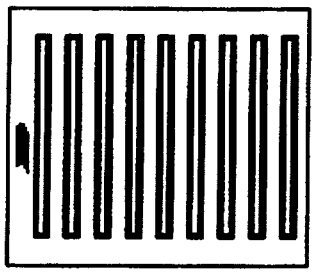
FIG. 6 is an intake face view of one of the four sizes of filters.

Referring now to FIG. 5, the basic construction of a baffle filter of the type used with the present invention is shown. This example is filter 29 and has four inlet slots 51 in the inlet face 52 thereof. These are defined by inwardly turned baffles 53 and 54, for example. The slots 51 are represented schematically in FIG. 1 by the four vertical lines in filter 29. Similarly, there are four vertical slots 56 in the outlet face 57 of the filter, each being formed by baffles such as 58 and 59, respectively. The thickness of the filter will be referred to hereinafter as the distance between the inlet upstream face 52 and the outlet downstream face 57.

Figure 7:
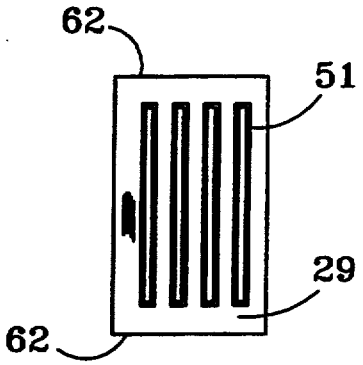
FIG. 7 is an intake face view of a second of the four sizes.
Figure 8:
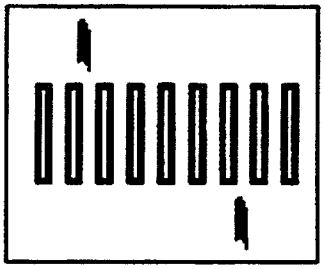
FIG. 8 is an intake face view of a third of the four sizes.
Figure 9:
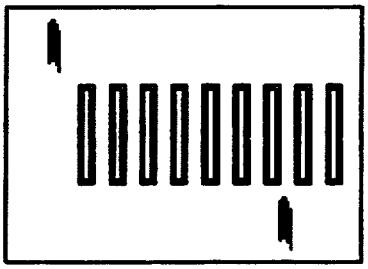
FIG. 9 is an intake face view of the fourth of the four sizes.

FIGS. 6, 7, 8 and 9 show four filters of the same basic construction as shown in FIG. 5, FIG. 7 being filter 29 of FIG. 5. The distance between the top 61 and bottom 62 of filter 29 is the same for all four of the filters. But otherwise, these filters are different in various respects. For convenience hereinafter, the filters of FIGS. 6, 7, 8 and 9 will be referred to by model number, broadly stated as models one, two, three and four, respectively. There are some differences in the slot lengths (heights), most noticeable by comparing model one with model three. There are also some differences in the number of slots. For example, model one has nine slots 21 inches long, while model three has nine slots only 10 inches long. Also, the thickness of model one is 1.675 inches, while that of model three is 1.495 inches. Thus, a more detailed model designation can be used, designating the slot length, filter width, and filter thickness. For example, model one can be designated 21/24/1.675, signifying 21 (slot length)/24 (filter width)/1.675 (filter thickness). Model two shown in FIG. 7 has slots which are 21 inches long in a filter 12 inches wide, and 1.927 inches thick. Therefore, a detailed model designation for this model two filter would be 21/12/1.927. Model three shown in FIG. 8 is 24 inches wide, has 9 slots that are 10 inches long, and is 1.495 inches thick. Thus it is designated 10/24/1.495. Model four is a filter 27 inches wide with nine slots 10 inches long, and is 1.495 inches thick. Therefore its detailed designation is 10/27/1.495.

The four models of filter can be combined in various ways to meet very stringent ventilation requirements as specified by the State of Michigan, for example, without disturbing the hood structure itself, because of several features of the present invention. First of all, and referring to FIG. 3, the back wall 63 of the hood has a lower margin defined by a bend forward at 64 to define the bottom 66 of a gutter whose front wall 67 defines the front of the gutter. A grease drain trough 68 includes a rear wall 69, closed ends 70, bottom 71, sloped down from the ends toward a hole in the center above the grease drain 34, vertical front wall 72, inclined wall 73, and down-turned flange 74 at the top front of the wall 73. This drain trough extends the full length of the hood from just inside the left end wall 22 to just inside the right end wall 23 of FIG. 1. It is supported by the down-turned flange 74 hooked over the top edge of the front wall 67 of the hood gutter. The grease trough wall 73 has a plurality of longitudinally spaced restrictor pins 75 welded to it and projecting upward and to the rear therefrom. The shaft of each pin is received in a slot 76 in the lower front face 52 of the filter. The head 75H of the pin is received through a slot-intercepting hole in the bottom of the filter and can keep the filter front face from being sucked back away from grease trough wall 73. The upper front face of the filter rests against the in-turned lower marginal flange 77 at the upper front margin 78 of the hood opening. Thus, each of the filters is supported by its intake face 52 resting against flange 77 at the top front of the margin of the hood opening and against the wall 73 of the grease drain trough and by the restrictor pin in the slot 76. An inclined lower rear wall 79 can be provided on the filters to prevent premature engagement of the lower rear edge of the filter with the front face of the trough wall 69 during installation of the filter and which could interfere with the filter location control feature of the restrictor pins.

The above description mentioned three different thicknesses of filters. One feature of the present invention enables the use of all three thicknesses, as well as others, if desired, in the same hood without modification. This is achieved in part by the control provided by the restrictor pin heads, and that accommodation of the inclined lower rear margin 79 of the thicker filters, but also achieved in part by a method of holding the upper portion of the filter snug against the flange 7. This is done by a rod 81 supported at spaced points by hanger posts 82. The rod has a top rib 83 extending along its length. A spacer ring or sleeve 84 is split at the top so it can be pushed up over the rod 81 in the direction of arrow 86, and come together against the rib 83. This ring is of a diameter such as to snugly engage the upper rear downstream face 57 of the filter and hold it snugly against the flange 77. Thus, the filter will adequately seal against the upper margin of the hood opening regardless of the air flow through it. As shown by the dotted lines at the top of the various filters in FIG. 1, each of the "rings" can be an elongated split sleeve received on the rod 81 such as at 84 for filter 29. Where a filter is a fairly wide filter, such as the others in the hood, two such sleeves can be installed on the rod to hold the upper marginal portion of the filter against the hood flange 77.

The lower edge of each filter remains sealed against grease trough wall 73 as a result of the combination of the filter weight and the restrictor pin heads. The drain trough 68 is sloped from its ends 70 downward toward the center so that grease collected and running down the filter baffles and out through the filter bottom holes such as 40 in the above-mentioned Doane patent into the drain trough, can move toward the center and down the drain tube 34 to a suitable collector (not shown).

As an example of how filters are selected according to the present invention, it may be first helpful to give an example of requirements for a conventional hood to meet the Michigan guidelines. Consider for example, two identically sized hoods, each 12'0" long by 4'0" wide hung back-to-back in island configuration over two line-ups of differently arranged cooking appliances. For purposes of explanation, the two hoods will be designated side A and side B. One exhaust duct is located equally on the top centers of the hoods and sized at 20" square. Full end curtains are on each end of each hood for minimum ventilation requirements, per the Michigan guidelines, and for maximum efficiency. Given the requirements of the Michigan guideline, the hoods each have 144" long exhaust chamber front openings that must be closed with filters operating at velocities between 275 and 400 f.p.m., and any area using blank filler panels cannot exceed 16% of the filter area. Also, the pressure drop across the filters must be at least 0.3" water gauge for a single duct opening in the 144" length. Side A has a 36" length of heat and grease appliances below the center of the hood (such as shown in FIG. 1), while the rest of side A of the hood covers low heat and low grease appliances. The side B would include low heat and low grease appliances under one-half of the length of the hood, with heat and grease appliances under the other half. On both sides, the distance from the cooking appliance surface to the bottom edge of the hood is 3.5 ft. Using the Michigan guidelines, the cubic feet per minute requirement would be:

1) Side A length of open front: 3' (over heat and grease appliance)×3.5' (height above appliance)×125 f.p.m. (volume through the 3'×3.5' opening required for heat and grease producing equipment)=1,313 c.f.m. The rest of this side requires 9'×3.5'×50 f.p.m. (velocity required for low heat and grease appliances)=1,575 c.f.m. Total for this side A of the hood equals 2,888 c.f.m.
2) Side B length of open front 6' (first half of side B)×3.5' (height)×50 f.p.m. (velocity required for low heat and low grease producing equipment)=1,050 c.f.m., plus 6' (second half)×3.5'

(height)×125 f.p.m. (velocity required for heat and grease appliances)=2,625 c.f.m. Total c.f.m. for this side B of hood equals 3,675 c.f.m. The total exhaust c.f.m. required is 6,563 c.f.m.

Example of Filter Calculations for Conventional Filters Using Conventional Flame Guard Filters Side A: Center of side A with heat and grease appliance of 36" and 1,313 c.f.m. would require a minimum of 3.283 total square feet of filter area (1,313 c.f.m./400 f.p.m.) or 1.642 square feet per filter (using two filters) and allow a maximum of 4.775 square feet (1,313 c.f.m./275 f.p.m.) or 2.388 square feet per filter (using two filters). The two center filters would be 25/20 at 656.6 c.f.m. per filter and 0.350" pressure drop. The balance of the filter opening 104" (144"−20"×2) leaves room for two filters on each side of the 25/20. The c.f.m. for these two areas is a total of 1,575. This is 394 c.f.m. per filter. The minimum area required is 0.985 square foot per filter (394 c.f.m./400 f.p.m.). The maximum is 1.433 square feet per filter (394/275). This can be accomplished using four 16/20 filters. With a 1.06 net square foot area the 16/20 is the only standard filter that complies with the velocity requirement. The pressure drop is 0.275". This falls below the 0.30" Michigan requirement. There however is not another standard filter that falls within the velocity requirements and can meet the pressure requirement. Air must be divided equally on each side of the center 25/20 filters. Maximum blank area at 16% prevents use of one filter on each side.

Side B: Low heat and low grease half of side B at 1,050 c.f.m. would require a minimum of 2.625 total square feet of filter area (1,050 c.f.m./400 f.p.m.) for 0.875 square feet per filter (2.625/3) (using three filters) and allow a maximum of 3.818 square feet (1,050 c.f.m./275 f.p.m.) or 1.273 square feet per filter (3.818/3). Three 16/20 filters at 350 c.f.m. per filter (1,050/3)=0.211" pressure drop. This is below the 0.30" minimum. There is however no conventional filter that will meet both the 0.30" pressure drop and the 16% maximum blank off. The second half of side B at 2,625 c.f.m. would require a minimum of 6.563 total square feet of filter area (2,625 c.f.m./400 f.p.m.) for 1.641 square feet per filter (using four filters) and allow a maximum of 9.545 square feet (2,625 c.f.m./275 f.p.m.) or 2.386 square feet per filter (using four filters). Four filters at 25/20 each would be required over the heat and grease appliances at 656 c.f.m. per filter and a 0.350" pressure drop. These seven filters do not evenly divide the hood, but the largest conventional filter at 25/20 cannot provide sufficient c.f.m. to accomplish the resulting square feet minimum with three filters. Within reason this is acceptable within the Michigan guidelines.

The problems with this example are difficult. 1) Different filter frames would be required on both sides. For example, side B would require two frames and side A would actually require three frames. This can be fabricated but makes an extremely custom hood. This customizing greatly limits future change. 2) The pressure differences and failure to meet the 0.030 minimum will require two separate duct connections on both side A and side B. The reality of the filter sizing is that more air will be pulled through the smaller filters and less through the larger until a pressure balance has been achieved. In reality this makes all the efforts to size air and filters to match the cooking appliances equipment less effective. What normally happens is that the ventilation c.f.m. is increased until enough air is realized over the appliances producing the most heat and grease; or the air ventilating the most heat and grease is disbursed throughout the length of the canopy until the total is exhausted. This can cause the additional grease to foul the entire ventilator instead of the area directly above the offending appliance. This increases the frequency and expense of cleaning required.

The filter system in the adjustable ventilator according to the present invention is designed to handle the above design problems without difficulty and maintain a standard hood construction design. It is important to first discuss the net free area design of any filter. The net free area is calculated using the number of slots in the filter face times the length (height) of the slot times the slot width (the distance separating the back edge of the front baffle from the front edge of the back baffle, W in FIG. 5). The air enters the space between the front baffles but must turn within the space between the front and back baffles. Standard baffle filters like the Flame Gard brand used in the above example must fit into a frame which, according to the industry standard, is made to accommodate a filter which is nominally 2" thick. Actual thickness (dimension T in FIG. 5) of the Flame Guard filter is 1¾". This industry standard leaves less than one inch of air space between the front and back baffles of the filter. The 25/20 Flame Gard filter in the above example uses 7 slots per filter. The air turns to each opposing side of six slots and only one side of the seventh slot. This equals a total of thirteen slots in the filter interior. Each slot is 22-7/16" long. The depth of slot W in FIG. 5 is 15/16" Therefore, 0.938"×22,438"×13=273,609 square inches/144 square inches per square foot=1.90 square feet net free effective area. A greater filter thickness could provide a greater net free effective area. But the filter thickness is a design feature limited by conventional industry standard hoods that can only accept one filter thickness. The filter frames must fit tight to the front of the filter top and bottom to keep the filter from falling out of the frame. The filter frame must fit relatively tight to the back of the filter to prevent the filter top and bottom from being sucked back into the housing when the exhaust air mover is activated, and which would create a gap between the filter face and front frame, thus allowing the grease laden ventilation air to bypass the filter. Filters will be sucked away from the front frames unless restrained by back frame devices, when operating at pressure drop minimums of 0.30".

The adjustable ventilator system of the present invention accomplishes: 1) a common uniform filter height, allowing any filter c.f.m. design to fit a common frame; 2) frames that allow different filter thicknesses; and 3) locating devices that permit only a dedicated filter to be installed in each filter opening. The first feature of the adjustable ventilator filters is that all filters are a common height regardless of filter c.f.m. design. The above example resulted in c.f.m.'s required based on the Michigan formula. It required custom filter frames to accept the various filter heights required. Using the same resulting ventilation air volumes, a different engineering formula can be determined by converting the resulting volumes to exhaust rates per lineal foot of hood filter area. Side B converts to 175 c.f.m. per foot on the low heat low grease half (1,050/6'=175 c.f.m. per foot) and to 437 c.f.m. per foot on the heat and grease half of side 1(2,625 c.f.m./6'=437.5 c.f.m. per foot). Side A converts to 437.5 c.f.m. per foot over the heat and grease appliance and to 175 c.f.m. per foot in the remaining nine feet of hood filter area (1,575 c.f.m./9'=175 c.f.m. per foot). These examples would require only filters rated at either 175 or 437.5 c.f.m. per foot. All filters, in the adjustable ventilator series are 25" high. This common height makes it possible for filters with 175 c.f.m. or 437.4 c.f.m. or other c.f.m. ratings per foot to be installed in any adjustable ventilator filter frame. The width of the filter accommodates the required c.f.m. per foot and the required design c.f.m. To demonstrate this sizing in the example, the following sizes would be used: Side B: All six filters would be 24" wide. Three filters would be 24" wide and rated at 175 c.f.m. per foot. Three filters would be 24" wide and rated at 437.5 c.f.m. per foot. Side A: Six filters will be used on side A. One 24" wide filter rated at 437.5 c.f.m. per foot and one 12" wide 437 c.f.m. per foot filter will be located above the 36" heat and grease appliances 17 and 18. Four 27" wide 175 c.f.m. per foot filters will be placed, two on each side of the 36" total 437.4 c.f.m. per foot filters. For optimum extraction efficiency, 300 f.p.m. is the design velocity for all filters used. To achieve a 437.5 c.f.m. per foot filter at 300 f.p.m., the net square feet free area per lineal foot of filter must be equal to 1.457 square feet (437/300=1.46). Using a 24" wide filter with nine slots (air on two sides of 8 slots and one side of one slot) equal to 17 air slots within the ventilator and an overall slot length of 21" (each slot is cut centered in the 25" overall filter height leaving a 2" wide blank at the top and bottom of each slot) the following filter thickness is determined: 437.5 c.f.m.×2'=875 c.f.m./300 f.p.m. required velocity=2.92 square feet required. At 144 square inches per square foot, the required 420.28 total square inches/17 ventilation slots=24.73 square inches per slot/21" slot length=1.175" required slot width (W, FIG. 5). Tolerances required for forming the baffles adds 0.5" to overall filter thickness (T, FIG. 5). Total filter thickness=1.675". Using the ASHRAE (American Society of Heating Refrigeration and Air Conditioning Engineers) guide for determining static pressure through devices used to transport air it can be determined that a constant velocity and a given ratio between the height and width of the transport area provides a constant pressure drop regardless of the size of the transport device or the volume of air.

Using the above formula to calculate the slot length and filter width the following filter dimensions are achieved: Size 1) 24" wide 437.5 c.f.m. per foot filter with 9 face slots is 25" (high)×24" (wide×1.675" (thick). Nine 21" long slots cut into the 25" high filter face. (437 c.f.m.×2'/300 f.p.m.×144 square inches/17 slots/21" slot length=1.175" slot width +0.5"=1.675" total filter thickness). Model designation 21/24/1.675. (25" height is not indicated as all filter blanks are 25" high, but with varying slot lengths as indicated.)

Size 2) 12" wide 437.5 c.f.m. per foot filter with 4 face slots=25"×12"×1.927". Four 21" long slots cut into the 25" high filter face. (437 c.f.m./300 f.p.m.×144 square inches/7 slots/21" slots=1.427" slot width +0.5"=1.927".) Model designation 21/12/1.927.

Size 3) 24" wide 175 c.f.m. per foot filter with 9 face slots=25"×24"×1.488". Nine 10" long slots cut into the 25" high filter face. (175 c.f.m.×2'/300 f.p.m.×144 square inches/17 slots/10" slots=0.988 slot width +0.5"=1.488".) Model designation 10/24/1.488.

Size 4) 27" wide×175 c.f.m. per filter with 10 face slots=25"×27"×1.495". Ten 10" long slots cut into the 25" high filter face. (175×2.25'/300 f.p.m.×144 square inches/19 slots/10" slots=0.995 slot width +0.5"=1.495".) Model designation 10/27/1.495.

In actuality, 24" filter size #3 above and the 27" filter size #4 above would each be 1.495" thick. At the given thicknesses the actual difference in c.f.m. at a constant 300 f.p.m. (determined by pressure) and at the different widths is only 0.1 c.f.m. per foot. The four filter sizes above require only one height but require three different filter thicknesses. The adjustable ventilator accommodates these different thicknesses by incorporating the adjustable top filter frame previously described. As a more specific example, the top frame consists of a ⅜" diameter rod 81 running horizontally the full length of the filter area. The top of the rod includes a square bar 83 protruding ⅛" above the rod and ¼" wide. The face of the rod closest to the back side of the filters is located 5/16" above the 1.927" thick 437 c.f.m. per filter. A circular split locking ring 84 whose body thickness is ¼" thick expands to fit over the rod and slides from the open rod end to the required position where it is held in place by compressing to the bar 83 at the top of the rod. The 1/16" clearance between the rod 81, the ¼" thick ring and the back face of the 1.927" thick filter allows for installation and removal tolerances. Compression holds the split ring in place along the length of the rod. As the thinner filters are added in various locations, split rings of increasing thickness are used. The 1.495" thick 175 cfm per foot filter requires a split ring 0.682" thick. The bottom frame is designed to fit the 1.675" thick filter. The thinner filter would slide farther down into the bottom frame but is stopped by the restrictor pin. Filters thicker than 1.675 incorporate the angled notch (wall 79 for filter 29, FIG. 3) at the outlet face bottom corner, allowing the filter to fit into the bottom frame.

Figures 3, 3A, 4:
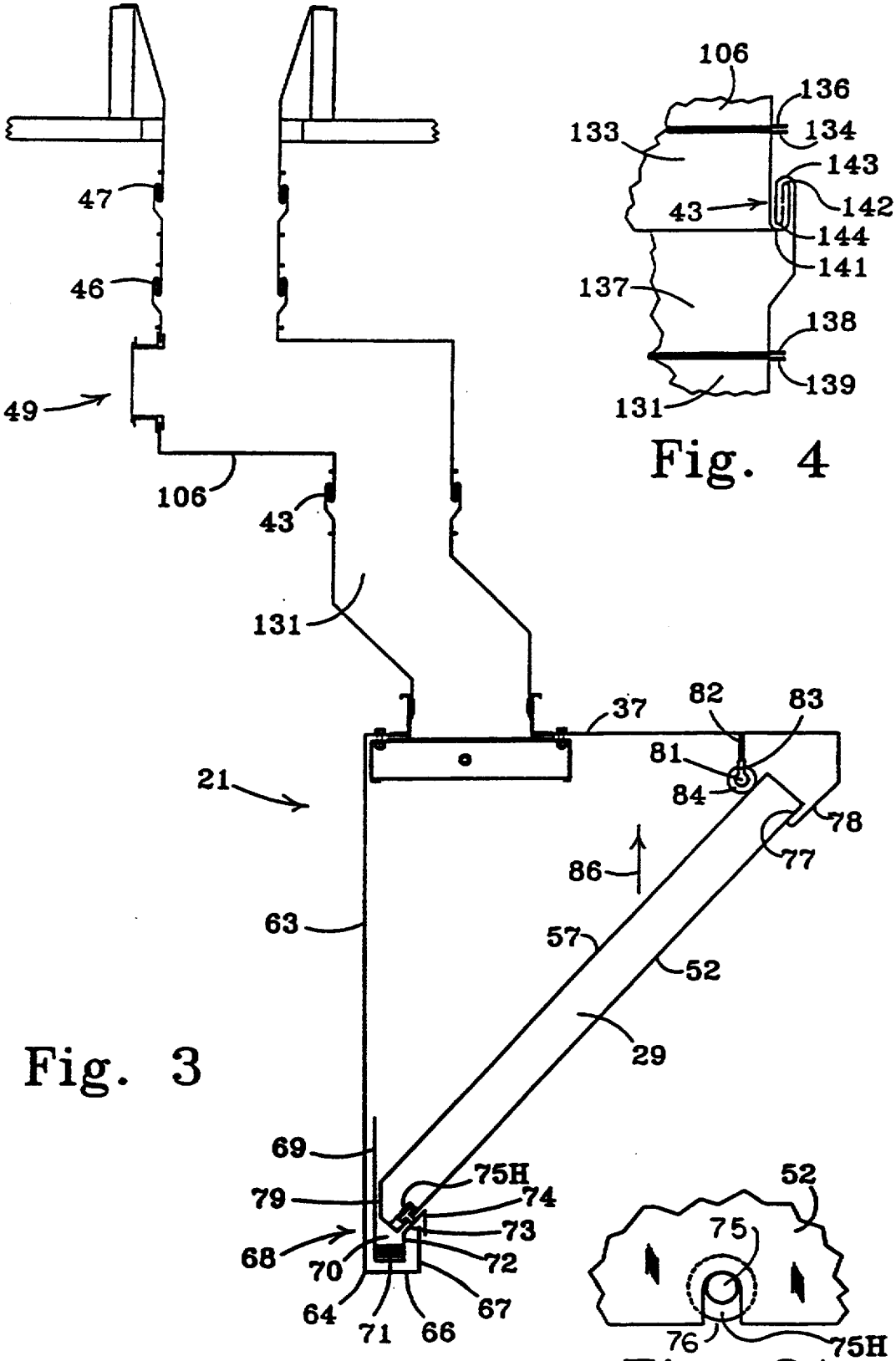
FIG. 3 is an enlarged vertical section through the exhaust portion of the hood and duct assembly.
FIG. 3A is an enlarged fragmentary view showing filter locator slot and pin combination.
FIG. 4 is an enlarged fragmentary sectional view of a snap joint in the duct.

Using the adjustable ventilator filters, the example included above for sides A and B can be properly ventilated using only four filter sizes. All sizes fit into the same frame. No custom hood fabrication is required. An additional feature of the adjustable ventilator insures that, after removal for cleaning, the filters are replaced into the same positions as those originally designed. Since all filters fit into the same frame height, and the thinner filters will fit under the split rings of smaller diameter intended for control of the thicker filters, another position limiting system is employed and located at the bottom of the filters. As mentioned previously, the grease entrapped by the filters drains down the baffles. At the base of the baffles are drain holes referred to as weep holes as in the Doane patent. These weep holes allow the collected grease to drain out of the filter and into the drip guard trough 68 (FIG. 3). As discussed above, the drip guard trough is pitched to drain the collected grease to a central container that is removable for disposal of the collected grease. The filters in the adjustable ventilator incorporate specially designed and located partially punched knock outs that, when removed will fit over corresponding restricting pins 75 (FIG. 3A). These pins are stud welded to the grease trough wall 73. The drain trough 68 is not permanently attached to the hood body but rests instead inside the bottom hood gutter 63, 66, 67. The filter knock-out hole locations are based on a maximum length single hood filter area of 14'0". This 14'0" long area would accommodate seven 24" wide filters. To individually locate filter position, seven knock-out hole locations are partially pre-punched at the bottom front corner of each filter. With the 437.5 c.f.m. per foot×24" wide filter (model 21/24/1.675) measured from left to right, the centerline of the first possible hole would be marked at 2" from the left end. To install the filters when a full bank of seven 21/24/1.675 filters are used, the drain trough wall 73 is fitted with seven locating pins. If the first filter is model 21/24/1.675, the first pin centerline will be located on the drain trough 2" from the left of the intended location of the first filter. The remaining six pins are installed on the wall 73 to correspond with the filter knock outs as is described further. The filter pre-punched knock-outs are then removed to correspond with the pin locations. Filter one (first one on the left) will have only the first pre-punched knock-out removed. The second filter, located to the immediate right of filter one, will have only the second pre-punched knock out removed. This pattern continues through the seventh filter. The seventh filter will have only the seventh pre-punched knock-out removed. The kitchen maintenance operator can use this effective combination of restrictor pins, locating holes and spacer rings to know which filter is to be installed in each location after cleaning or service.

The following are examples of the centerline location dimensions for the pre-punched filter knock-outs for four different sizes of filters to be used in two examples.

Size 1) 24" wide 437 c.f.m. per foot filter with nine face slots=Model designation 21/24/1.675. The first knock-out location is 2" from the left side. The other six are spaced at 3.5" from each other, leaving the last location 1.0" from the right-hand side.

Size 2) 12" wide 437 c.f.m. per foot filter with four face slots=Model designation 21/12/1.927. The first knock-out location is 1" from the left side. The other six are spaced at 1.5", leaving the last one 2.0" from the right hand side.

Size 3) 24" wide 175 c.f.m. per foot filter with nine face slots=Model designation 10/24/1.488. The first knock-out location is 0.5" from the left side. The other six are spaced at 3.5", leaving the last pin 2.5" from the right hand side.

Size 4) 27" wide 175 c.f.m. per foot filter with nine face slots=Model designation 10/27/1.495. The first knock-out is 1.5" from the left side. The other six are spaced at 3.5" leaving the last pin 4.5" from the right hand side.

An example of side B filter restrictor pin placement on the grease drain trough 68 for the filter organization for the side B cooking appliance arrangement mentioned above is:

The left to right, pin centerline to pin centerline distance with low heat low grease filter size 3 the left is: 05"-27.5"-27.5"; then converting to heat and grease, handling filter size 1 and adding 2" for first locating hole in the size 1 filter base 29"-27.5"-27.5". Each filter will have the corresponding knock-out removed, thus only allowing the correct filter to be installed at each location. Each filter will also have the corresponding spacer ring installed on the top rear frame rod above the filter.

The above mentioned side A is a typical condition and here the hood section contains three different filter widths, three different filter thicknesses and two different slot lengths. Each filter placement corresponds with the air volume required to properly ventilate the appliance located beneath the filter. In this typical application the pin location and pin function is critical.

On this side the filter knock-out removal and pin placement begins at the right and progresses to the left to avoid situations where filters of the same model may be used on both sides of a hood but are commingled after removal for cleaning. If the knock-out removal locations and corresponding pin placements were counted from left to right on one side, and right to left on the other side, the possibility of re-installing them in the wrong locations is avoided. An example of side A filter restrictor pin placement on the drain trough, and measuring from right to left, with the low heat low grease 27" wide filter on right the dimensions are: 4.5"-30.5" (converting to heat and grease with 24" wide filter)-27"-22.5" (converting to the 12" wide filter)-24"-(converting back to the 27" filter over the low heat low grease appliances)-30.5", leaving 5" from the last pin to the left-hand end.

In summary, the filter knock-out corresponding to filter position along a hood will be removed, allowing only the correct filter to be installed in each location on the drain trough. In addition, the difference in location of the first and seventh hole from the filter side nearest the hole allows the hole location to be selected and designated left to right in hood B and right to left in hood A, further assuring replacement of filters to the correct side and correct placement on each side. Once the restrictor pin and knock-out locations are determined, the corresponding spacer rings are slid over the top filter retainer rod. Two rings are placed for each filter. The rings are placed close to the outside edges of each filter. Now this system is complete. The different thicknesses have been allowed for by the use of the spacer rings to ensure a tight leak free fit and the restrictor pins and knock-outs ensure the correct filter will be replaced to the correct location after cleaning or service.

It is worth remembering that the hood filter frame is the same on both sides of this hood. In the event the operator changes or relocates equipment it is a simple matter to adjust the ventilator to the new appliance line up. A new filter line-up is determined and a new drain trough 68 is manufactured. It is determined how many of the existing filters can be relocated to properly ventilate the new appliance line-up. Restrictor pins are installed on the new drain trough at the new locations. The new drain troughs, any new filters required and new spacer rings are sent to the operator. The old drain troughs are removed and the new drain troughs installed. New filters are installed where required and the correct spacer rings are slid over the top retainer rod. A drawing is furnished to the operator indicating the correct knock-out locations for the new line up. The operator punches out knock-outs to align the old filters to the new locations. Any new filters come pre-punched. For any old filters that can be used in the new line-up, a knock-out cover is furnished to be installed by two pop rivets to cover any locating holes in old filters that might otherwise confuse the placement of an old filter in its new location.

Referring again to FIGS. 1–3 and FIGS. 10 and 11, the field-installed collar assembly is a liquid tight exhaust collar that can be installed in the field with no welding required. This means that the collar can be field located to miss pipes, trusses, electrical conduits and the like. In some instances it might even be possible to align the exhaust collar with the roof curb around the opening in the roof through which the exhaust duct is to pass. In the case illustrated in FIGS. 1-3, even though it was possible to locate the duct and exhaust collar midway between the ends of the duct, passage through the space between the ceiling and the roof exhaust blower mounting curb can be considered to have mechanical members and devices (not shown) necessitating the offsets and elbows as shown in FIGS. 2 and 3.

The collar assembly is made of three primary components, the one-piece inner collar 91 and a two-piece "hammer in" outer collar 92-93. The inner collar 91 includes a square frame 94 with an outwardly turned perimetrical lower flange 96 and an outwardly turned upper perimetrical flange 97. The upper flange has a down-turned lip along two parallel outer edges as shown at 98 in FIG. 10. For the installation of the collar assembly, a hole is cut in the top 37 of the hood. It is made large enough that the upper flange 97 would just barely pass through the hole as the collar is pushed up from under the hood, access being obtained through the frontal opening. A gasket 101 resting on the lower flange can be brought up to seal against the lower face of the hood top 37. This is done by installing the two pieces 92 and 93. Each of these pieces 92 and 93 has a tapered side. That is to say that, for piece 92, the height of the wall 92F decreases from the corner 92C to the end 92E. In contrast, the height of the wall 92W is the same at the corner 92C as it is at the end 92Z.

In a similar manner, the height of the wall 93F is greater at the corner 93C than it is at the end 93E. The height of the wall 93W is the same at the corner 93C as it is at the end 93Z. Therefore, after the inner collar 91 is pushed up in the opening as far as it will go, the end 92E of the outer collar piece 92 is inserted between the top of the hood and the bottom of flange 97, being captured by the down-turned lip 98 hanging over the edge of the top flange 92T. The bottom flange 92B of collar piece 92 rests on top of the hood. Then, with a rubber or other suitable mallet, the piece 92 can be hammered in the direction of arrow 102 (upward out of the paper in FIG. 10). As it is driven inward between the hood top 37 and the inner collar flange 97, it pulls the inner collar up so that the flange 96 presses the gasket 101 into engagement with the bottom of the hood top. In like manner, the collar piece 93 is hammered in the direction of arrow 103 with the out-turned flange 93T captured under the flange 97 of the inner collar and confined by the down-turned lip 98 of the inner collar while the bottom flange 93B of the piece 93 engages the top of the hood. As this piece is driven in the direction of arrow 103 (down into the paper in FIG. 10) it pulls that side of the inner collar up so that the flange 96 forces the gasket 101 against the underside of the hood top.

As an example, where the collar dimension is 12" square, the hole cut in the hood top is ⅝" larger in width and length on each side to allow the ½" top flange 97 of the inner collar to pass up through it during installation. The two pieces 92 and 93 which can be referred to as "tapered compression slides", are started under the top lip of the collar in the directions of arrow 102 and 103 for slides 92 and 93, respectively. Since the vertical sides of the slides are tapered, this makes it possible to start each slide under the collar top lip. As the slides are hammered in around the inner collar, the inner collar is pulled up tighter and tighter until the gasket is compressed thus, completing the seal on the inside edge of inner collar to the inside top of the hood plenum. The slides are driven in until the end tabs or gussets as at corners 92Z and 93Z, are aligned with the end of the adjacent frame wall. Pre-drilled holes in each flange, upon alignment with the pre-drilled holes in the gussets, indicate that the flanges are properly installed. Screws are then placed in each set of aligning holes thereby locking the collar in place. Thus, a collar has been field-installed in a liquid tight manner without welding, and with a hammer, screw driver and wrench for tools.

Figure 12:
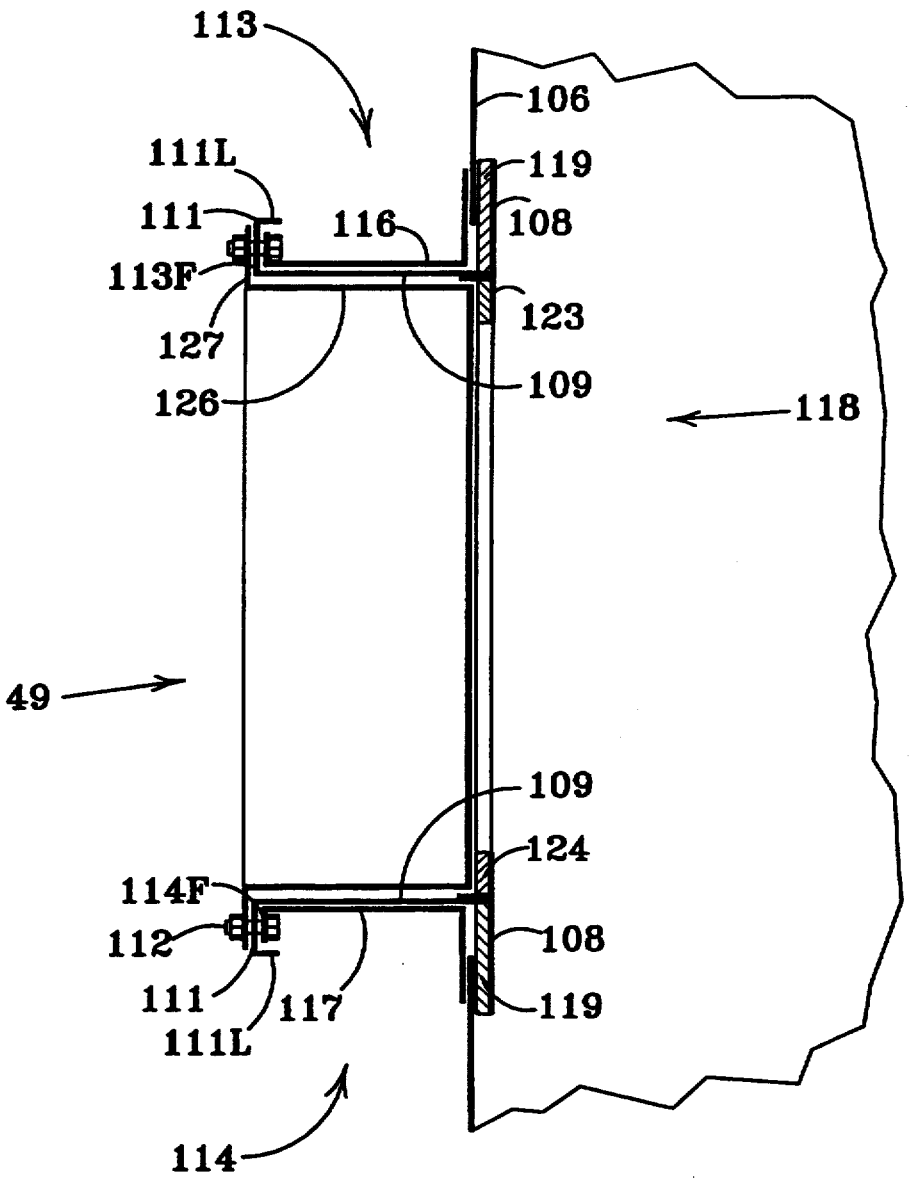
FIG. 12 is an enlarged fragmentary sectional view through the access door portion of the exhaust duct assembly.
Figure 13:
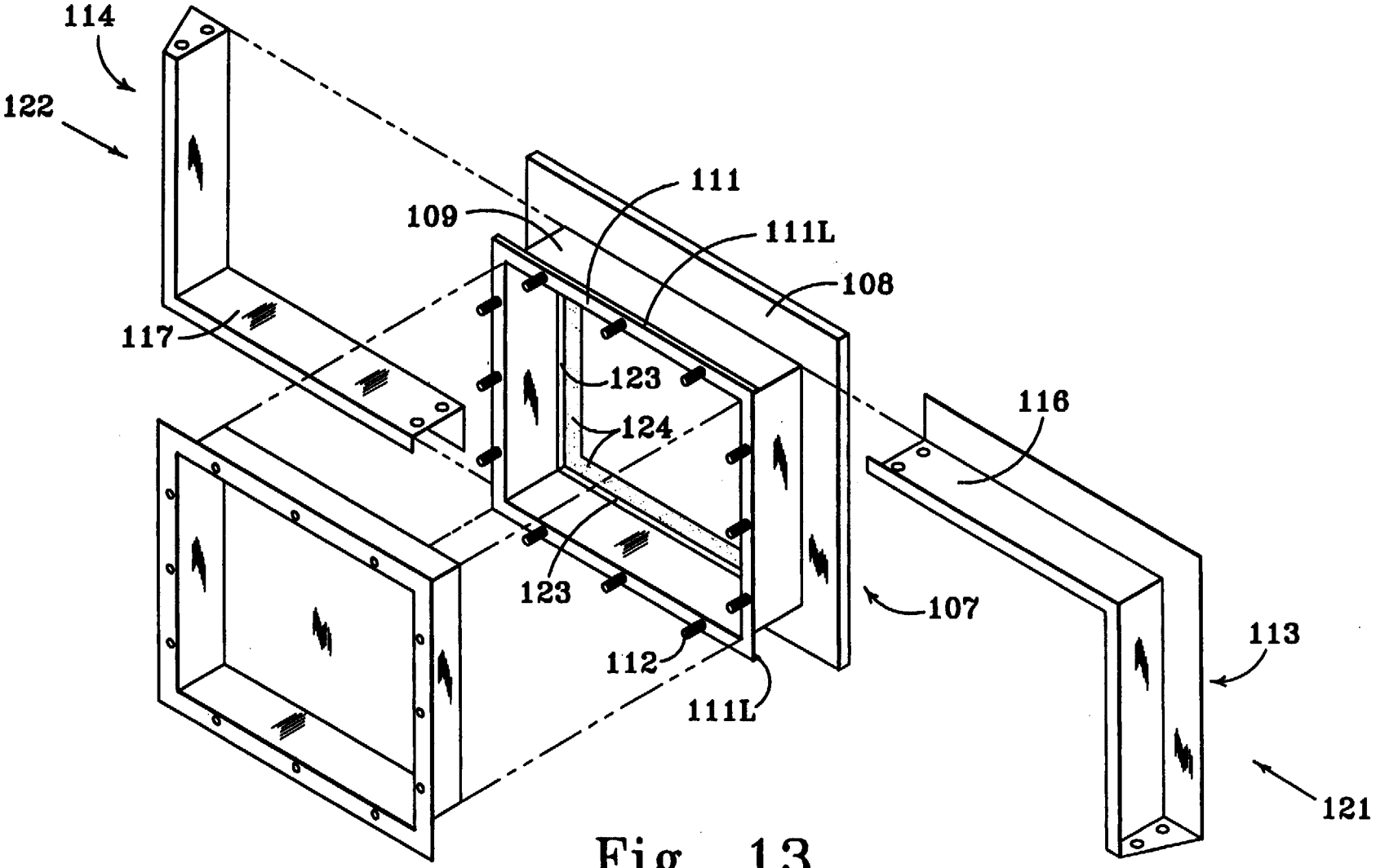
FIG. 13 is an exploded pictorial view of the access door components prior to assembly into the exhaust duct.
Figure 14:
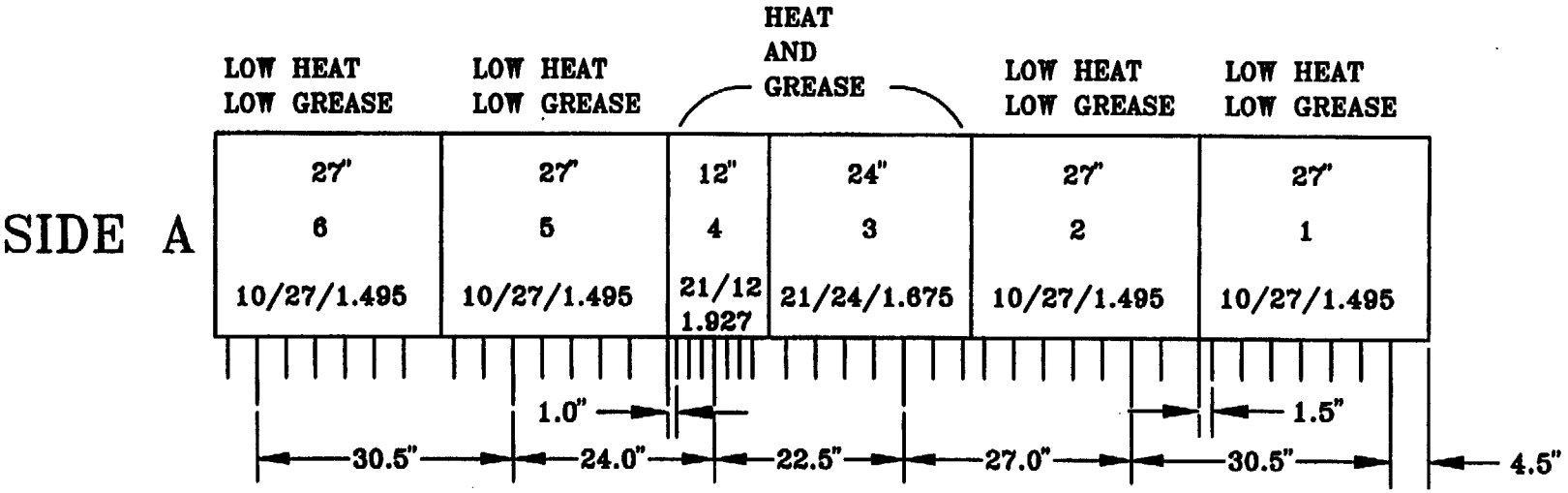
FIG. 14 is a chart showing filter and locator pin arrangements for the hood of FIG. 1.
Figure 15:
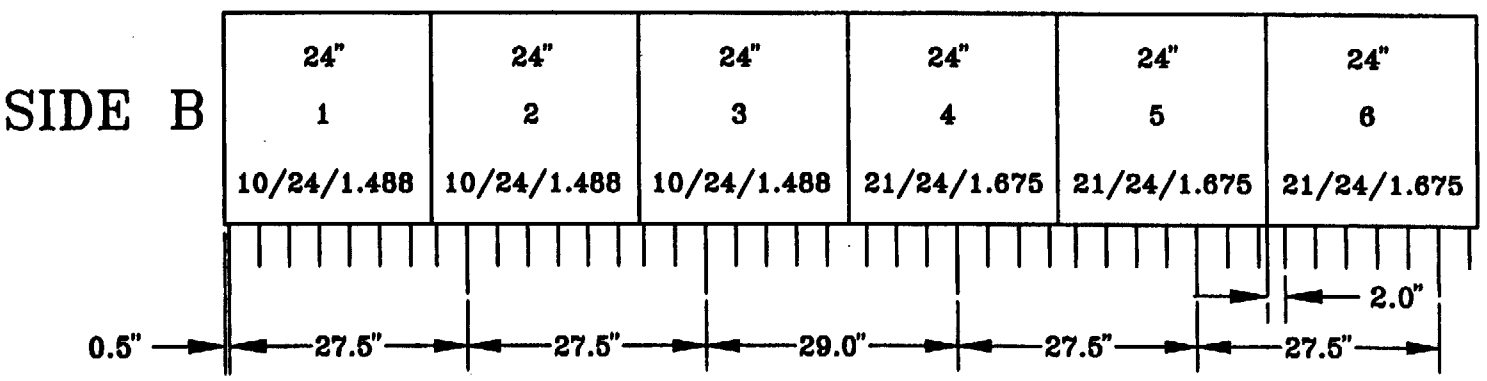
FIG. 15 is a chart showing filter and pin arrangements for another line-up of cooking equipment as could be on the opposite side of the line-up in FIG. 1 in a canopy hood arrangement, if desired.

Referring now to FIGS. 3, 12 and 13, the above-mentioned access door assembly is very similar to the duct collar in construction and installation. It can be most readily installed in the double elbow duct section 106 before that section is assembled with the rest of the sections in the space between the ceiling and roof. The one-piece door frame 107 has a perimetrical flange 108 which is normally situated inside the duct, a wall 109 which passes through the hole cut in the wall of the duct, and a perimetrical flange 111 with a plurality of threaded studs 112 mounted on it. Two "hammer-in" outer collar parts 113 and 114 are provided. Part 113 has a tapered side 116 and part 114 has a tapered side 117. After the door frame is inserted through the wall opening in the duct in the direction of arrow 118, so that the gasket 119 on flange 108 contacts the duct wall, piece 113 is inserted in the direction of arrow 121 FIG. 13 (into the paper in FIG. 12) with its flange 113F received under the in-turned lip 111L of the flange 111 at the top of the door frame. Similarly, collar piece 114 is inserted in the direction of arrow 122 (out of the paper in FIG. 12) so that its flange 114F is captured between the flange 111 and lip 111L at the bottom of the door frame. These two outer collar pieces 113 and 114 are driven home in the direction of arrows 121 and 122, respectively. While so doing, they pull the flange 108 and thereby the gasket 119 snug up against the wall 106 of the duct. It should be understood of course in this example, as well as for the duct collar of FIGS. 10 and 11, that the lips on the short flanges (97 on the duct collar and 111 on the door frame) extend only on those edges of the flanges that are parallel to the direction of insertion of the hammer-in collar pieces. As indicated with reference to the duct collar, pre-drilled holes in each of collar slides 113 and 114, particularly the flanges 113F and 114F and in the flange 111 of the door frame, will aligned themselves when the flanges are properly installed. Screws can then be placed in each of the set of aligning holes to lock the slide-in collar pieces in place and thus lock the door frame in place.

Further with reference to the door frame, and before installation of the frame in the duct, a door stop flange frame 123 is secured and sealed to the walls 109 of the door frame and has a gasket 124 on its outer face. After securing the door frame in the duct, the access door 126 is installed. Its outer flange 127 is fastened to the flange 111 of the door frame by nuts on the studs. The nuts on the studs holding the door in the door frame are tightened until the gasket 124 on the gasket angle frame 123 is compressed all around its perimeter to provide a liquid tight seal between the door frame and the gasket. Thus, we have a field-installed access door that is liquid tight and required no welding and no tools other than a hammer, screw driver and wrench. In both instances of mounting the duct collar to the hood and the access door frame to the duct, a suitable tool is needed, of course, to cut the relevant opening to receive the collar assembly.

Figure 10:
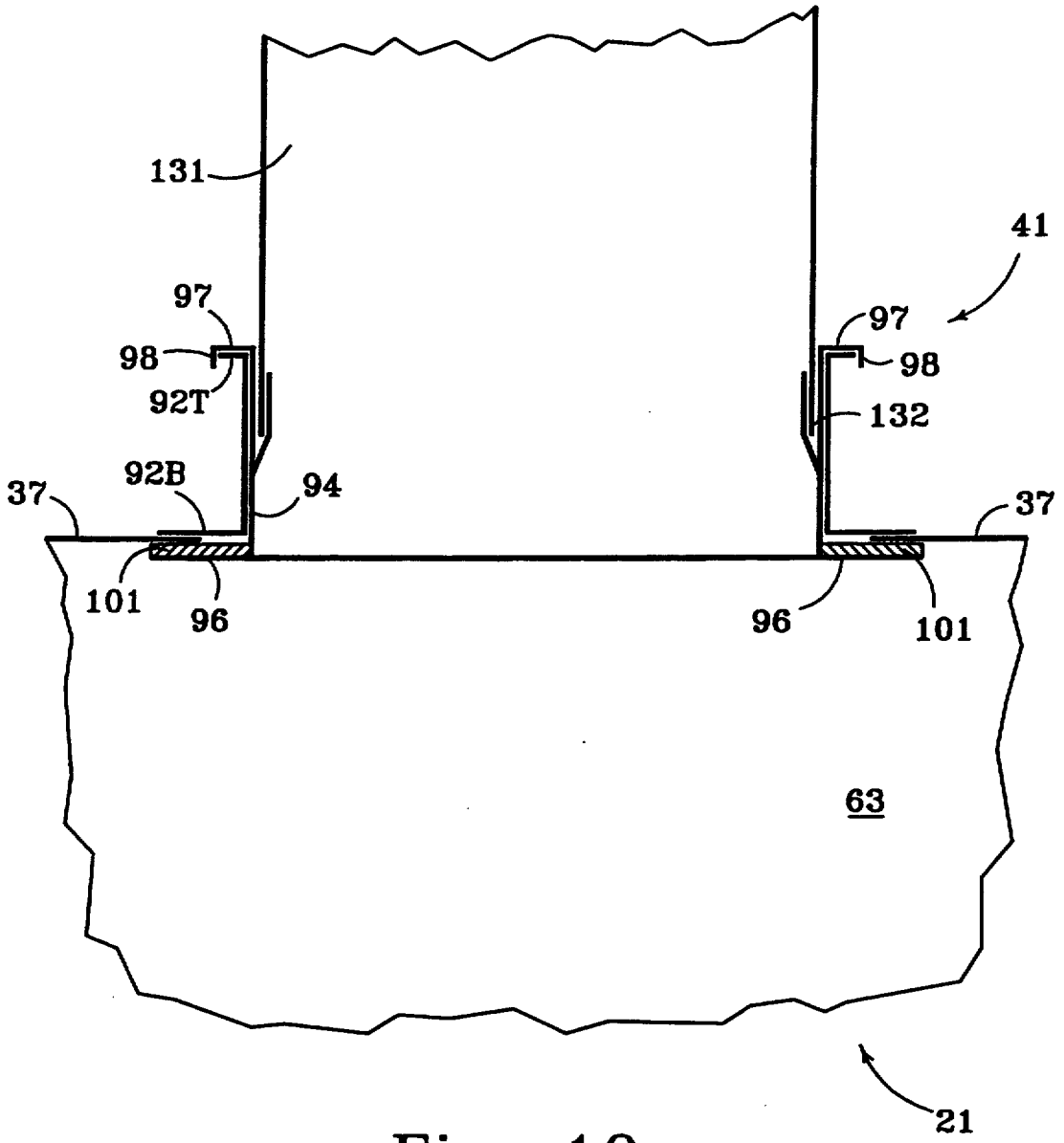
FIG. 10 is an enlarged fragmentary section through the top of the hood at the exhaust collar to duct transition.
Figure 11:
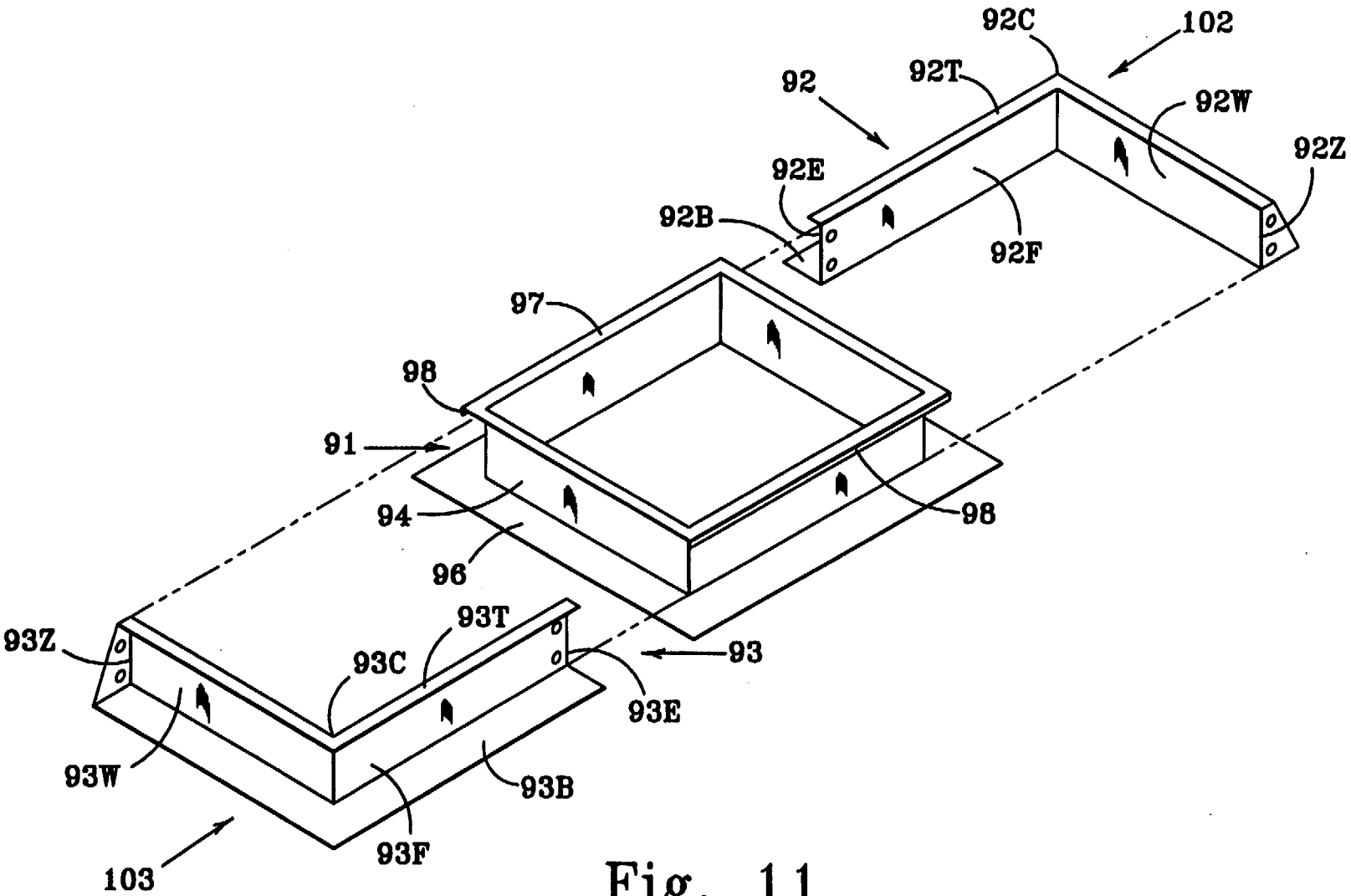
FIG. 11 is an exploded pictorial view of the exhaust collar parts before assembly.

In the above description of FIGS. 1 and 2, joints 43, 46 and 47 were mentioned. One such joint is shown enlarged in FIG. 4 connecting the double elbow section 106 to the double offset section 131. The lower end of the double offset section is received inside the duct collar where it may be supported by the slip joint 132 (FIG. 10). As shown in FIG. 3, and which is typical of the four walls of each duct section, a collar 133 has out-turned flange 134 thereon which may be factory welded to the out-turned flange 136 of the duct section 106. A collar 137 is welded or otherwise sealed at its flange 138 to the double offset section 131, the collar having the flange 138 cooperating with flange 139 on duct section 131. The collar 133 has a double hem-like lower margin where it is turned up at 141 and down at 142 and ends at a lower edge about halfway between the bend 141 and 142. Similarly, the lower collar has a hem-like arrangement where the upper margin of it is turned downwardly at 143 and upwardly at 144 and terminates halfway between 143 and 144. In the field, the section 106 can be pushed downward into section 131, with the collar hem portion received inboard of the collar hem portion of collar 137 until the top edge 142 of the upper collar passes the bottom edge 144 of the lower collar whereupon the edge 142 which was pressed inwardly during the installation, can snap outward and the edge 144 of the lower collar which was forced outward during installation can snap inward. Then the upper duct section can be pulled upward until the parts are in about the relationship shown in FIG. 4, but cannot be further separated because the free edges of the hem-like portions would interfere with each other, thus preventing separation. In this manner, with the upper collar inside the lower collar in a sort of locking plug-in-socket relationship, any grease, rain, or other fluid which might pass downward in the duct will not get outside the duct wall. Also, the relationship with the parts permits some longitudinal expansion without separation. The same construction as shown in FIG. 4 is used at the other joints 46 and 47.

Figure 16:
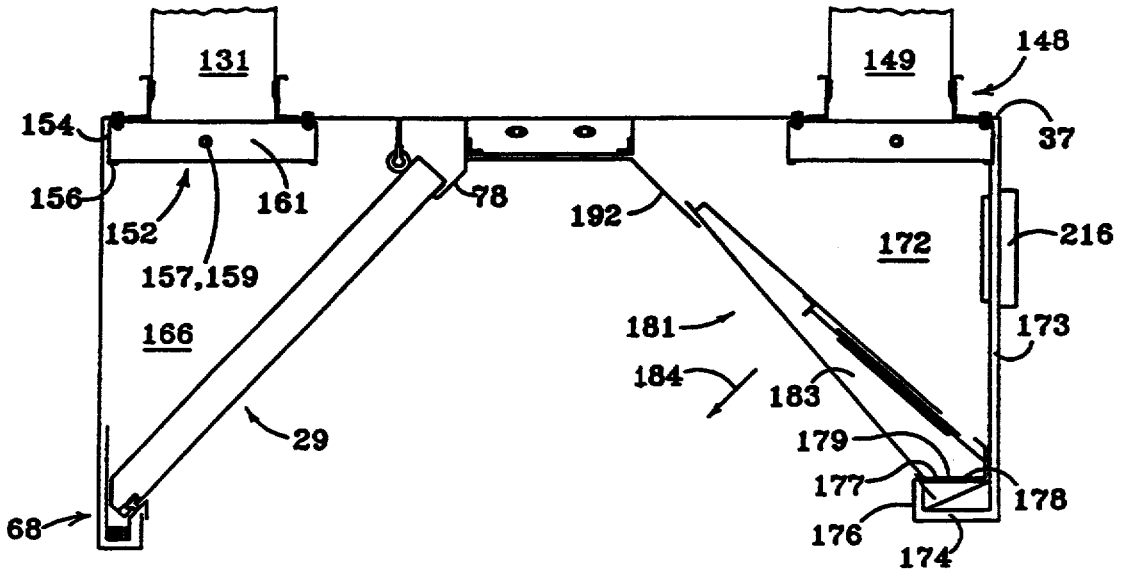
FIG. 16 is a cross sectional view through a ventilator similar to FIG. 2 but on a larger scale and also including a make-up air diffuser and fire dampers in both the exhaust and make-up air sides of the hood.
Figure 17:
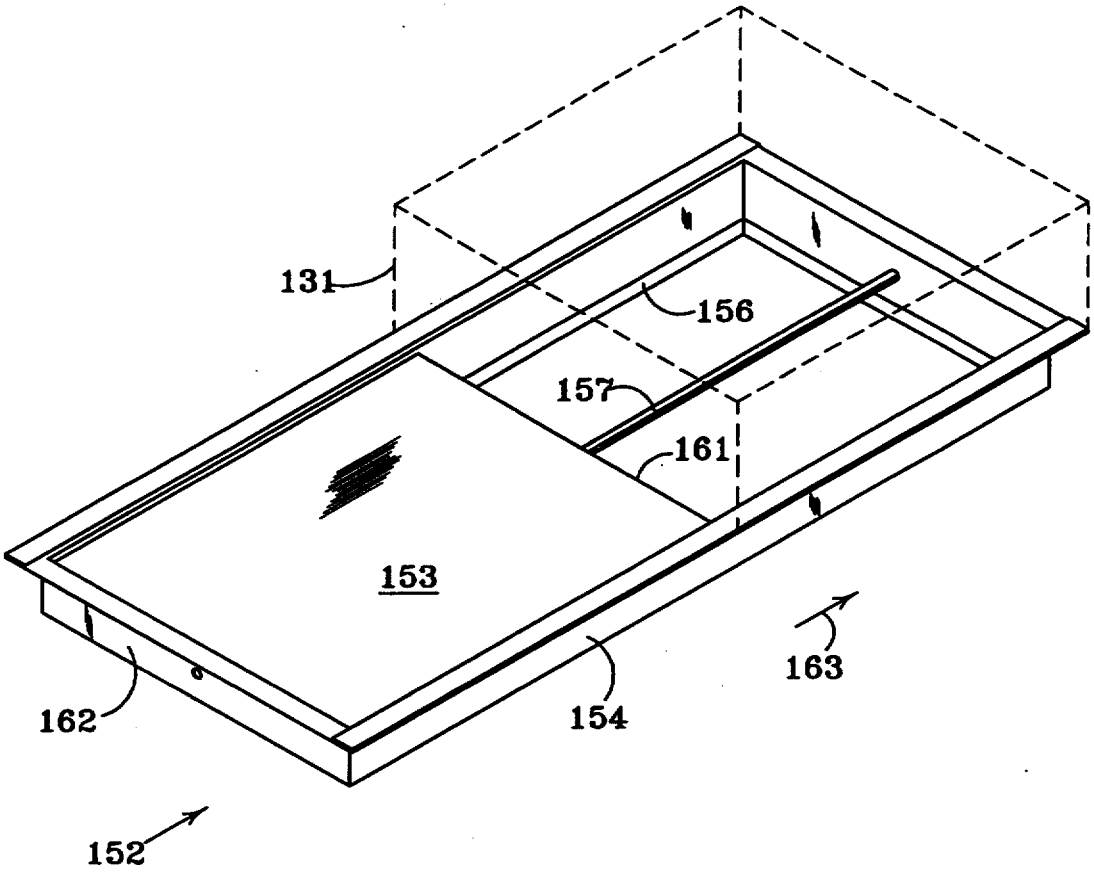
FIG. 17 is a perspective view of a fire damper as used in the top of the ventilator hood of FIG. 16.

Referring now to FIG. 16, the hood assembly as shown there can be assembled with the same drive-in collar arrangement 148 for the make-up air intake duct 149 as for the exhaust duct as previously described in the top of 37 of the hood.

According to another feature of this invention, an adjustable fire damper is provided under the duct-to-hood collar at the top of the hood at the exhaust opening and at the make-up air intake opening. Each of these dampers is in an assembly, and a description of one will suffice for both, since they are essentially identical.

Figure 18:
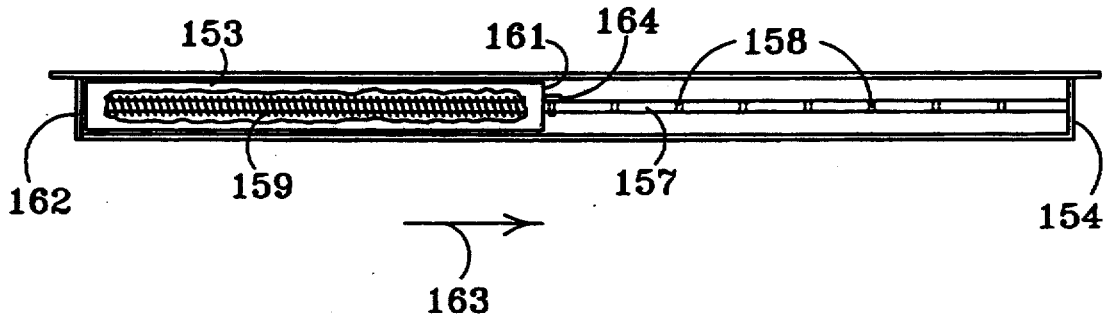
FIG. 18 is a longitudinal sectional view through the fire damper.

Referring to the exhaust damper assembly 152 under the exhaust opening in the top of the hood, and as shown in FIG. 16, it is a generally rectangular assembly, and the relationship thereof to the opening surrounded by the exhaust collar 41 is shown. It is essentially a box 153 slidably mounted in the frame 154 and guided by the in-turned flanges such as 156 at the bottom of each side of the frame. The frame is fastened to the underside of the hood top 37. A rod 157 is centrally located and secured between the ends of the frame 154, and has a plurality of vertical holes 158 longitudinally spaced along its length. In FIG. 18, a portion of the side of box 153 is broken out to show a compression spring 159 inside the box 153 and engaging the front end 161 of the box on the inside. The other end of the spring abuts the end inside face of 162 of the frame 154. This spring constantly urges the box in the direction of the arrow 163 which is a direction which would close the exhaust opening in the top of the hood. The box 153 can be maintained in any one of a multiple of desired positions along the length of the rod 157 by inserting a fusible pin 164 in whichever of the holes is appropriate to provide the amount of closure of the opening in the air flow path and the exhaust as will be needed for the maximum conditions of ventilation required for the particular set of cooking appliances located under and along the length of the hood as will be described more specifically hereinafter.

Referring again to FIG. 16, the exhaust plenum 166 which extends the full length of the hood from the near end to the far end, has the sloping front wall 78 extending down from the top 37 of the hood. The split ring arrangement holds the upper end of each filter of a series of exhaust filters such as 29 which are mounted end-to-end in the opening between the upper panel 78 and the grease trough 68 as previously described.

The make-up air plenum 172 has an insulated front wall 173 which is turned toward the rear to provide a lower edge 174 and then turned upward at 176. A support box 177 is mounted in the U-shaped channel provided by the wall portions 173, 174 and 176. It has a plurality of holes spaced along the top of it from end-to-end of the hood to receive key pins 178. These are receivable in holes in the bottom wall 179 of each of a set of combination make-up air diffuser and fire damper assemblies 181. Since all of these are the same, a description of one will suffice for all.

Figure 19:
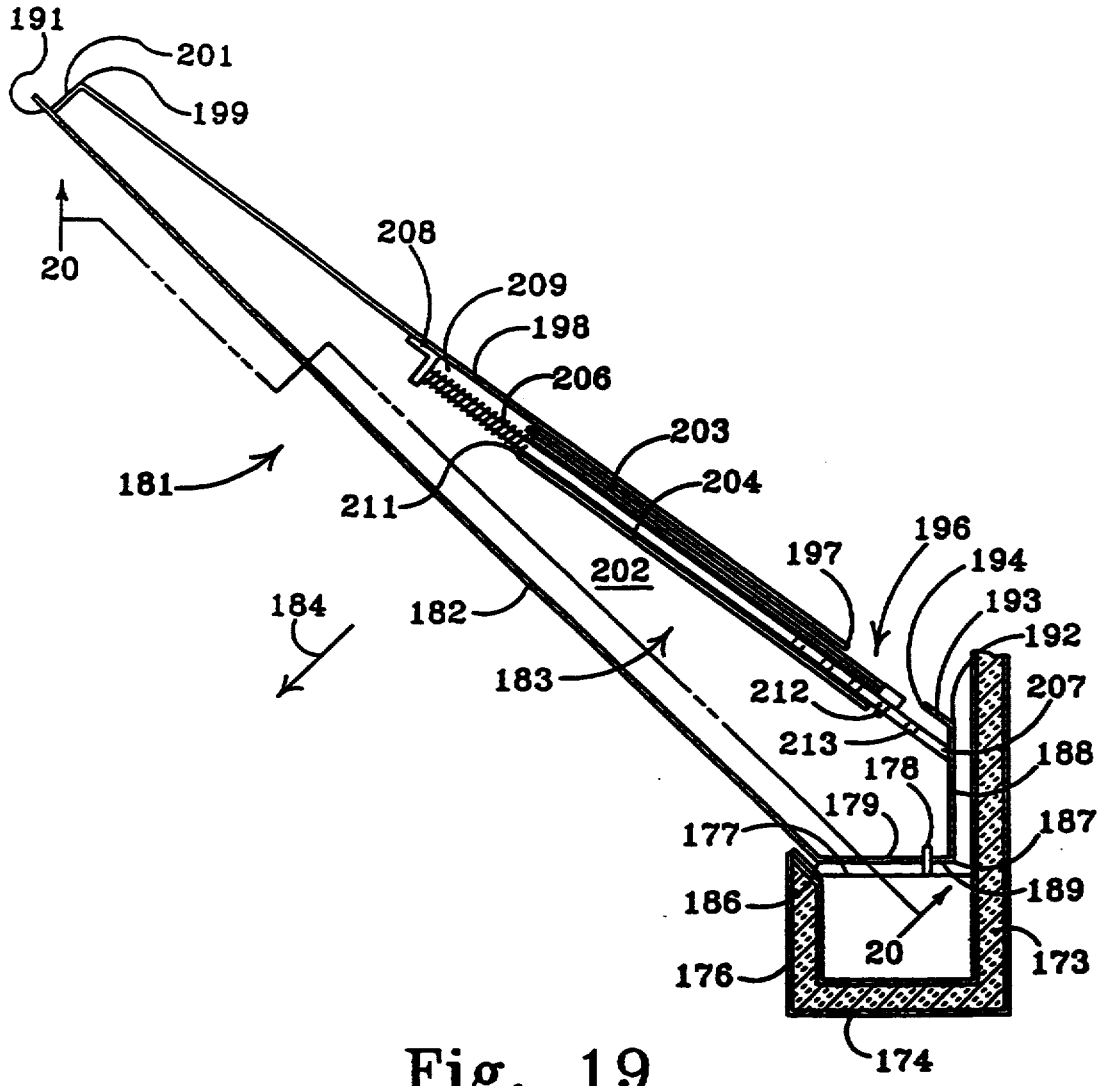
FIG. 19 is a section through an adjustable fire damper at the make-up air plenum.
Figure 20:
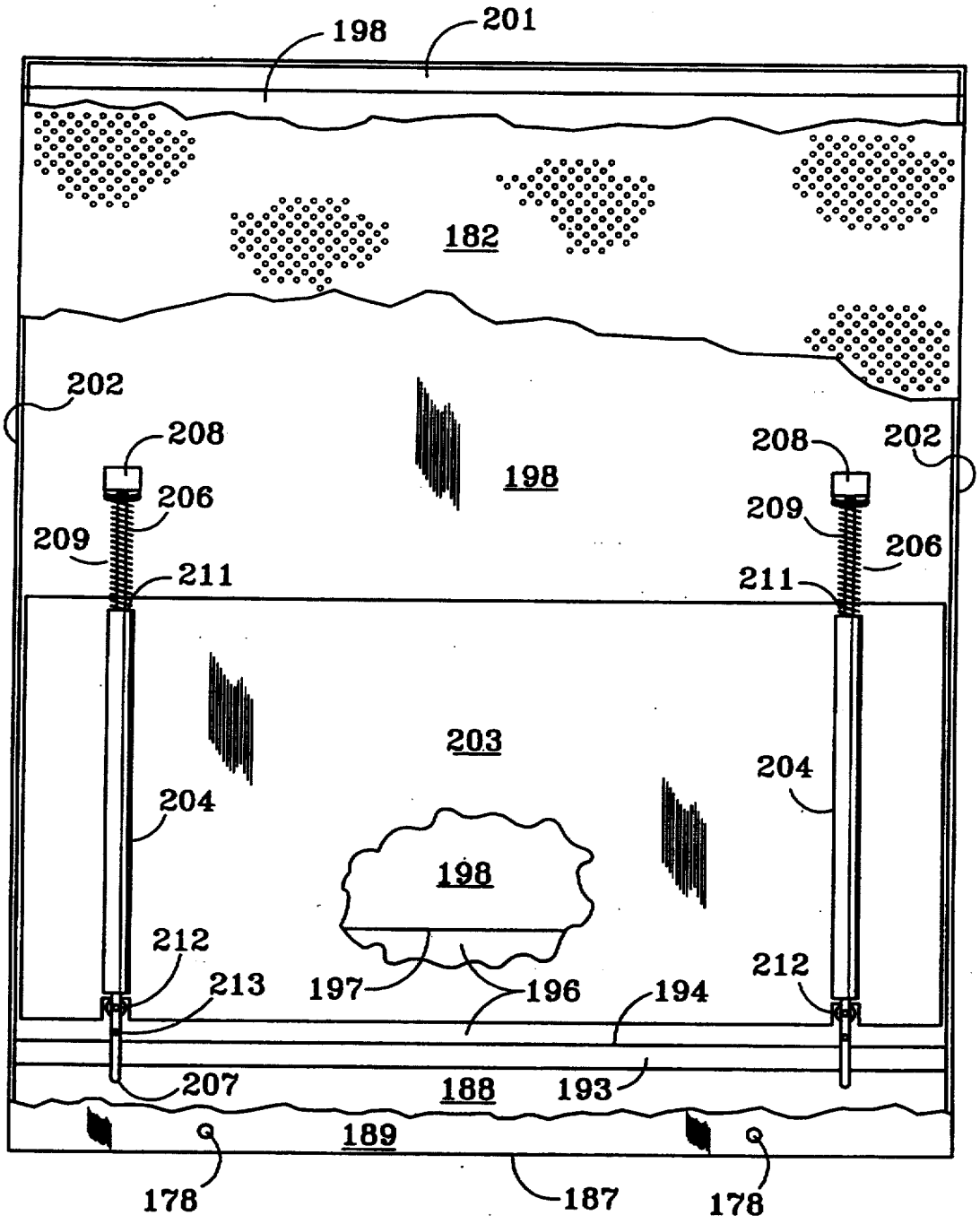
FIG. 20 is a view from the bottom of the make-up air fire damper, with a portion broken away to show the interior details.

Referring to FIGS. 19 and 20 along with FIG. 2, each of the diffuser assembly includes a sheet metal face 182 which is perforated with small holes throughout its entire area to diffuse air from the space 183 into the hood in the direction of arrow 184. The metal sheet bends outward from face 182 at the line 186 defining its lower edge and continues out to a line 187 where it bends upward to define the outer wall 188 thereof. The portions 179 and 188 of the sheet do not have the diffuser perforations. At a couple of locations along the length of each diffuser assembly, such as at 189, it has a hole in the bottom 179 which receives the locator pin 178 extending up from the top of the box 177.

The upper margin 191 of the diffuser face sheet 182 is solid and rests on the downwardly sloping make-up air plenum upper wall 192 (FIG. 16) to support the upper end of the assembly 181.

Referring further to FIG. 19, the vertical wall 188 ends at line 192 where the sheet bends and is sloped upward to the left providing a short sloping wall 193, and stops at the edge 194 which is the lower edge of a slot 196. The upper edge 197 of the slot is the lower edge of the upper wall 198 of the diffuser assembly and which continues up to the left to a line 199 at the top where it bends down along the length of the unit to provide a narrow top wall 201 which closes with the wall portion 191 to complete the assembly. Consequently, the diffuser assembly has a diffuser chamber or plenum 183 in it defined by the diffuser face 182, a lower wall 179, the outer wall 188, the short wall 193, the upper wall 198, and the top wall 201 and opposite end walls such as the far end wall 202 and the near end wall (not shown in FIG. 19 due to it being cut away to show the interior details).

In addition to being a diffuser assembly 181, it is a fire damper assembly. The fire damper is essentially a plate 203 having a pair of horizontally spaced guide tubes 204 mounted on the lower surface and which are slidably received on guide rods 206 which are horizontally spaced and extend upward from a point near the top of the wall 188 as at 207 to mounting brackets 208 secured to the underside of the wall 198 which is to serve as a fire wall, if necessary. A compression spring 209 is mounted between the lower face of the bracket 208 and the upper end 211 of the guide tube 204. This spring urges the tube, and thereby the damper plate 203, in a downward direction. But the downward travel of the plate is limited by an adjustment pin 212 which is received in one of a plurality of holes such as 213 which are spaced along the length of the rod 206 from the lower end thereof to a point slightly above the lower edge 197 of the upper wall 198 of the assembly. Pins 212 are fusible so that, in case of fire, the pin will melt away and the damper plate 203 will be driven downward by the spring 109 to close the slot 196 and thus complete the fire wall. In the illustration of FIG. 19, the pin is located so that the slot is a little less than half open. The pin could be placed in one of the holes that are farther up on the rod 206 to enable the slot to be fully open.

Operation

As suggested above, the various features of the invention are intended to be used to best ventilate the cooking equipment in use in the kitchen, regardless of the nature of the equipment. This involves some "balancing".

First, the maximum possible air handling requirement for the most demanding possible combination of kitchen equipment is determined. The exhaust blower and the make-up air blower, and the attendant ductwork are sized to handle this maximum potential requirement. Then the requirement for the kitchen equipment to be used is determined. If this required volume usually stated in cubic feet per minute (cfm) is less than the maximum, the first balancing features used are the horizontal adjustable setting fire dampers 152 located parallel to the top plane of the ventilator inside the exhaust and mua plenums. When the required cfm is lower than the design maximum, each damper is closed to preset pin locations located along the length of the damper slide rod 157. Closing the damper restricts the opening, increasing the pressure drop through the opening and reducing the volume of air being removed from the exhaust plenum or supplied into the mua plenum. This balancing feature sets the total cfm requirement for the entire plenum being served by this particular horizontal adjustable setting fire damper but does not consider where this cfm may be required over the length of the plenum by specific appliances.

The second balancing feature is provided in the row of filters such as 27, 28, 29, 31, 32 and 33 of FIG. 1, for example, located at the face of the exhaust plenum. They are sized and arranged as already discussed in detail. As the horizontal adjustable fire dampers 152 allow a given volume of air to be exhausted from the exhaust plenum, this second feature of providing a selection of filters with different capacities can divide this overall cfm volume for removal as required in sections down the length of the plenum. The filter restricting pins ensure that the proper filters will be reinstalled in the proper locations after removal for inspection or cleaning.

The third balancing feature is the adjustable setting fire dampers located on the intake slot of the mua diffusers. When the required cfm is lower than the design maximum, the damper is closed to a suitable one of the plurality of possible preset pin locations located down the length of the damper's slide rod 206. Closing this damper restricts the opening, increasing the pressure drop through the opening and reducing the volume of air being supplied from the mua plenum. This application is similar to the horizontal adjustable setting fire damper located at the top of the mua plenum. The horizontal damper at the top of the plenum regulates the amount of air introduced into the entire plenum. The adjustable dampers on the intake slot of each diffuser distribute the correct amount of air into each diffuser so that the air supplied through the diffuser corresponds to the amount of air being exhausted through the baffle filter directly opposite. In addition, the location of the fire damper in the intake slot, with the fusible pin 212 exposed to flames of any uncontrolled cooking fire at the cooking appliance below it, provides a fire break inside the plenum, thus preventing that diffuser from discharging air out of the face of the ventilator. Accordingly there will be no introduction of make-up air from this diffuser into the flames of a cooking fire which is being contained within the exhaust portion of the ventilator and which might otherwise be encouraged to migrate back into or toward the mua plenum and out of the front of the ventilator through a mua plenum front face diffuser such as 216 (FIG. 16) for example, into the kitchen.

To accommodate future changes the dampers can be readjusted. A new drain trough can be installed and new restrictor pin locations set for a new or re-arranged set of filters.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a kitchen ventilator having a hood extending longitudinally in a space above a row of cooking units for removing cooking fumes resulting from operation of the cooking units, and wherein the hood has an intake opening defined by upper and lower marginal portions supporting removable grease filters with intake faces sloping downwardly and rearwardly over the cooking units, the improvement comprising:

a locating device mounted at the lower marginal portion; and a plurality of indexing pins spaced along the locating device according to a pattern related to different fume generating potentials of different cooking units in the row;

the grease filters disposed in the opening having receivers therein spaced according to a code of different spacings related to different filtering capacity of the filters, the receivers receiving the pins for correct fitting reception of the filters in the opening, whereby filters of different capacity are organized along the locating device over the row of cooking units in locations above the different cooking units having fume generating potential to which the filter capacity corresponds.

2. The improvement of claim 1 and wherein:

the locating device is unitarily removable from the hood for convenient replacement by a locating device having a different pattern of pin spacings to receive filters of different capacities in an organization corresponding to a different arrangement of cooking units having different fume generating potential.

3. The improvement of claim 1 and wherein:
the receivers are in the intake face of the filters.

4. The improvement of claim 1 and wherein:
the filters of different capacities are the same overall intake face height.

5. The improvement of claim 4 and wherein:
some filters of different capacities are of different thickness.

6. The improvement of claim 4 and wherein:
some filters of different capacities have the same overall intake face dimensions.

7. The improvement of claim 1 and further comprising:
a back stop mounted behind the upper marginal portion to retain the filters in fitting engagement with the upper frontal marginal portion of the opening.

8. The improvement of claim 1 and wherein the backstop includes:
a rod extending longitudinally in the hood;
a plurality of rings fittingly received on the rod;
the rings being of various outside diameters to fittingly engage the rear outlet faces of filters of different thicknesses.

9. The improvement of claim 8 and wherein:
the rings are resilient and each ring has a transverse split to facilitate removal from and installation on the rod without removal of the rod from the hood.

10. In a kitchen ventilator including an inlet for air from a room and an outlet for delivery of air to a room, the improvement comprising:
first and second fire damper plates adjacent the inlet and outlet, respectively and resiliently biased in inlet and outlet closing directions respectively, the first fire damper plate being maintained open by a fusible pin, said pin being manually positionable to establish a predetermined opening for air flow through the inlet, and manually repositionable to change the opening for air flow through the inlet.

11. The improvement of claim 10 and further comprising:
a removable filter in an air flow path upstream of the first damper plate.

12. The improvement of claim 10 and wherein the ventilator is a hood, the improvement further comprising:
a plurality of filters located side by side in the hood upstream of the inlet;
a filter locating member in the hood with a plurality of coding devices thereon,
the filters having coding devices thereon representative of different flow ratings and cooperable with the coding devices in the hood so as to be positionable only at compatible spaced locations along the length of the hood.

13. The improvement of claim 12 wherein:
the coding devices in the hood are pins located at selected locations in the hood; and
the coding devices in the filters are notches sized to receive the pins when the notches are in registry with the pins.

14. The improvement of claim 10 and further comprising:
a make-up air plenum in the ventilator downstream of the outlet; and
a diffuser assembly providing a wall of the make-up air plenum and including:
a perforated diffuser face for delivering make-up air from the plenum into the kitchen;
a fire wall above the diffuser face and cooperating with the diffuser face to provide a plenum inside the diffuser assembly, the fire wall having an opening therein to admit air from the make-up air plenum into the diffuser above the diffuser face for delivery from the diffuser face into the kitchen; and
the second fire damper plate as a slidable plate movable inside the diffuser assembly from a first position permitting air to freely flow through the opening in the fire wall to a second position completely closing the opening.

15. The improvement of claim 14 and further comprising:
resilient means biasing the slidable plate in a direction from the first position to the second position of the plate;
guide rod means inside the diffuser assembly for guiding the plate from the first position to the second position; and
selectably positionable stop means on the guide rod means to hold the plate in one of a plurality of possible locations to close a selectable percentage of the opening in the fire wall.

16. The improvement of claim 15 and wherein:
the stop means are fusible in a fire so as to release the slidable plate to completely close the opening in the fire wall in case of fire in the hood.

17. In a kitchen ventilator including an exhaust plenum for collecting cooking fumes from a kitchen, and including a make-up air plenum for supply of make-up air, the improvement comprising:
fire damper in one the plenums and operable in response to excessive sensed temperature to close and inhibit gas flow in the one plenum; and
the fire damper being resiliently biased in a closing direction and maintained open by a fusible pin, said pin being manually positionable to establish a predetermined opening for gas flow past the damper, the pin being manually repositionable to change the opening for gas flow.

18. In a kitchen ventilator including an exhaust plenum for collecting cooking fumes from a kitchen, and including a make-up air plenum for supply of make-up air, the improvement comprising:
a fire damper in one of the plenums and operable in response to excessive sensed temperature to close and inhibit gas flow in the one plenum; and
a diffuser assembly providing a wall of the make-up air plenum and including:
a perforated diffuser face for delivering make-up air from the make-up air plenum into the kitchen;
a fire wall above the diffuser face and cooperating with the diffuser face to provide a plenum inside the diffuser assembly, the fire wall having an opening therein to admit air from the make-up air plenum into the diffuser above the diffuser face for delivery from the diffuser face into the kitchen; and
a slidable plate serving as the damper and movable inside the diffuser assembly from a first position permitting air to freely flow through the opening in the fire wall to a second position completely closing the opening.

19. The improvement of claim 18 and further comprising:

resilient means biasing the slidable plate in a direction from the first position to the second position of the plate;

guide rod means inside the diffuser assembly for guiding the plate from the first position to the second position; and selectably positionable stop means on the guide rod means to hold the plate in one of a plurality of possible locations to close a selectable percentage of the opening in the fire wall.

20. The improvement of claim 19 and wherein:

the ventilator is a hood and the stop means are fusible in a fire so as to release the slidable plate to completely close the opening in the fire wall in case of fire in the hood.

21. The improvement of claim 1 and wherein:

each of the filters has "n" possible locations for one of the pin receivers therein, and pin receivers are provided in the filters along the locating device according to a pattern of 1 through "n" for filters 1 through "n" numbering from one end of the first filter and where "n" is the total number of filters organized along the locating device.

22. The improvement of claim 21 and wherein:

a knock-out spot is provided at each of the "n" locations to facilitate removal of one knockout to provide the pin receiver at the appropriate location for each of the filters.

23. The improvement of claim 21 and wherein:

the first knock-out spot from one end of a filter is located a different distance from that end for each filter of different capacity.

24. The improvement of claim 21 and further comprising:

a second intake opening in the hood defined by upper and lower marginal portions supporting a second group of removable grease filters with intake faces associated with a second row to cooking units;

a second locating device mounted at the lower marginal portion of the second opening; and a second plurality of indexing pins spaced along the second locating device according to a pattern related to different fume generating potentials of different cooking units in the second row;

the grease filters in the second group having pin receivers at knock-out locations therein where knock-outs have been removed according to a numbering pattern beginning at the same end of the hood from which the numbering pattern for the first-mentioned set of filters began.

25. The improvement of claim 1 and further comprising:

an exhaust duct connecting collar assembly in the top of the hood and including an inner collar frame received through an opening in the top of the hood and having a first laterally extending flange portion extending outboard of the opening and seated on the underside of the top of the hood, the frame having a second laterally extending flange portion above the top of the hood, with wedges between the top of the hood and the second flange portion holding the frame securely in the opening.

26. The improvement of claim 25 and wherein:

the inner collar frame is rectangular and has four walls extending through the hood top opening; and the wedges are two right-angle outer collars, each outer collar having two walls immediately adjacent two of the four walls of the inner collar.

27. The improvement of claim 26 and wherein:

the second flange portion has a downturned lip thereon for guiding the outer collars.

28. The improvement of claim 26 and further comprising an access door in the duct.

29. A method of assembling duct to hood and comprising the steps of:

introducing a flanged collar through an opening in the top of a hood and stopping the travel by abutment of one flange with the hood top;

driving a wedge between the hood top and another flange on the collar and which is located on the side of the hood top opposite that where the one flange abuts, and thereby securing the flanged collar in the hood top; and connecting a duct to the collar.

30. The method of claim 29 and further comprising the step of:

driving a second wedge between the hood top and a second portion of the another flange.

31. The method of claim 30 and further comprising the step of:

fastening the first and second wedges together after driving them into place securing the flanged collar in the hood.

32. A method of properly relocating the filters in a set in a hood and comprising the steps of:

placing the filters in a side-by-side relationship in a row, with the filters arranged with indexing pin receivers therein located on indexing pins in the hood.

33. The method of claim 32 and further comprising the steps of:

providing on each of the filters a number of possible locations of index pin receivers therein corresponding to at least as many index pin receiving filters as there are in the row;

punching out in each filter one of the index pin receivers selected according to the position of the filter in the row; and placing in the hood an indexing pin located at the position of each punched out receiver.

* * * * *